US006247255B1

(12) United States Patent
Clendenning

(10) Patent No.: US 6,247,255 B1
(45) Date of Patent: Jun. 19, 2001

(54) MULTIPIECE EXCAVATING TOOTH ASSEMBLY

(75) Inventor: Charles Clendenning, Broken Arrow, OK (US)

(73) Assignee: H&L Tooth Company, Tulsa, OK (US)

( * ) Notice: Subject to any disclaimer, the term of this patent is extended or adjusted under 35 U.S.C. 154(b) by 0 days.

(21) Appl. No.: 09/448,737

(22) Filed: Nov. 24, 1999

Related U.S. Application Data

(63) Continuation of application No. 09/118,658, filed on Jul. 17, 1998, now Pat. No. 6,047,487.

(51) Int. Cl.[7] ..... E02F 9/28
(52) U.S. Cl. ..... 37/452; 37/456
(58) Field of Search ..... 37/452, 453, 454, 37/460, 455

(56) References Cited

U.S. PATENT DOCUMENTS

| | | | | |
|---|---|---|---|---|
| 1,909,850 | * | 5/1933 | Younie | 37/454 |
| 2,118,872 | * | 5/1938 | Weimer | 37/454 |
| 2,227,674 | * | 1/1941 | Ratkowski | 37/454 |
| 3,117,386 | * | 1/1964 | Ferwerda | 37/454 |
| 4,317,300 | * | 3/1982 | Emrich et al. | 37/453 |
| 4,481,728 | * | 11/1984 | Mulder et al. | 37/452 |
| 4,711,503 | * | 12/1987 | Berchem et al. | 37/142 |
| 5,016,365 | * | 5/1991 | Robinson | 37/453 |
| 5,224,282 | * | 7/1993 | Swick | 37/454 |
| 5,666,748 | * | 9/1997 | Emrich et al. | 37/453 |
| 5,778,570 | * | 7/1998 | Eichelberger | 37/454 |

FOREIGN PATENT DOCUMENTS

| | | | | |
|---|---|---|---|---|
| 000999895 | * | 11/1976 | (CA) | 37/453 |
| 002938119 | * | 4/1981 | (DE) | 37/454 |
| 0038389062 | * | 5/1990 | (DE) | 37/454 |
| 4345100A1 | * | 12/1993 | (DE) . | |
| 2264140 | * | 3/1974 | (FR) . | |

* cited by examiner

*Primary Examiner*—Thomas B. Will
*Assistant Examiner*—Kristine Markovich
(74) *Attorney, Agent, or Firm*—John W. Harbst

(57) ABSTRACT

A multipiece excavating tooth assembly including an adapter, a digging or excavating tooth, and retaining pin structure for interconnecting the adapter and tooth in operable combination relative to each other. The tooth and adapter have a uniquely configured interface or conjuncture therebetween. Moreover, the conjuncture between the digging tooth and adapter is configured to advantageously orientate the retaining pin structure to avoid those problems inherent with conventional vertical and horizontal pin systems.

36 Claims, 13 Drawing Sheets

MULTIPIECE EXCAVATING TOOTH ASSEMBLY

RELATED APPLICATION

This application is a continuation patent application of my coassigned United States patent application Ser. No. 09/118,658, filed Jul. 17, 1998; now U.S. Pat. No. 6,047,487.

FIELD OF THE INVENTION

The present invention generally relates to ground engaging equipment and, more specifically, to a multipiece excavating tooth assembly including an excavation tooth and adapter operably interconnected relative to each other by retaining pin structure.

BACKGROUND OF THE INVENTION

Excavating equipment used in mining, construction, and a myriad of other ground engaging operations, typically includes a series of spaced apart ground engaging teeth mounted in side-by-side relation across a bucket lip. The teeth project forwardly to engage and break up the material to be gathered in the bucket. The art recognized long ago the advantages to be obtained by connecting the relatively small digging or excavating tooth to a relatively large adapter or support which, in turn, is connected to the bucket or excavating equipment. Typically, the adapter or support includes a base portion configured for attachment to the forward lip of a bucket and a free ended nose portion. In many applications, the conjuncture between the digging tooth and adapter involves providing the digging or excavating tooth with a pocket or cavity which opens to the rear of the tooth and fits over and along a substantial length of the nose portion of the adapter. A suitable pin operably interconnects the tooth and adapter in operable relationship relative to each other.

Typically, and especially in today's global economy, the components comprising a ground engaging multipiece tooth assembly are manufactured and/or fabricated in various global locations. That is, a digging tooth or tip can be manufactured or fabricated in one part of the world, i.e., China while the adapter or support for the tooth can be independently manufactured or fabricated in another part of the world, i.e., Mexico. It is common for these separate parts or components of the digging tooth assembly to be brought together only where the machine or apparatus on which they are to be arranged in manufactured and assembled. Accordingly, the parts or components of the multipiece tooth assembly require liberal tolerances to enable the parts fabricated at various global manufacturing facilities to fit and operate in combination relative to each other.

As will be appreciated by those skilled in the art, when connected to a bucket or the like, excavating tooth assemblies are often subject to highly abrasive conditions and, thus, experience rapid and considerable wear. Moreover, the relative high forces developed during operation of the excavating tooth assembly furthermore add to the rapid wear of the component parts of the excavating tooth assembly. Typically, each digging tooth is provided with a cutting edge extending across a forward edge of the tooth to facilitate penetration and breakup of the ground. The cutting edge of each tooth is oriented to extend transversely of the tooth and in generally parallel relationship with the work surface being excavated or dug.

In service, and although specific steps may have been applied to the tooth during its fabrication, the forward cutting edge of the tooth wears and quickly becomes dull and inefficient in the digging operation and, thus, require replacement. The multipiece construction of a tooth assembly advantageously allows the digging or excavating tooth of the assembly to be replaced independent of the adapter. Depending upon the type of excavation involved, a given adapter can be successively equipped with anywhere from five to thirty replacement teeth to maintain sharp penetrating edges. In the field, replacement of worn excavating tooth parts is a common and sometimes daily experience.

As can be appreciated, during an excavating, digging or loading operation extremely high vertical forces are imparted to each excavating tooth assembly associated with the excavating equipment. A conventional adapter or support has generally flat top and bottom surfaces upon which corresponding flat surfaces of the digging tooth bear upon. Under extreme loading conditions, and although interconnected through a pin or the like, the digging or excavating tooth tends to move forwardly and downwardly relative to the nose portion of the adapter. The loose fit between the component parts furthermore adds to relative movement between the tooth and adapter or support. The tendency of the tooth to move relative to the adapter exacerbates the wear problem especially in the pocket area and along the nose portion of the adapter. The existence of dust and dirt between the sliding confronting suifaces on the digging tooth and adapter furthermore adds to the deterioration of the component parts of the excavating tooth assembly. Thus, the critical conjuncture between the digging tooth and adapter is subject to accelerated wear conditions which can result in tooth pocket failure and/or premature adapter replacement.

While the vertical loads imparted to each tooth assembly during a ground engaging operation are significant, the horizontal or lateral loading imparted to the teeth are also of concern. For example, and as will be appreciated, the horizontal loads and forces imparted to a digging tooth affixed to a ripper and the like ground engaging equipment can be significant. Accordingly, each digging tooth assembly needs to be configured to accommodate both horizontal and vertical loads imparted thereto during normal operation. Of course, if the excavating tooth should break during operation, intermingling of a broken tooth component with the remainder of the excavated materials can cause significant material handling problems in subsequent operations, i.e., crushing operations. If a tooth or point is lost, the adapter quickly will become damaged as the nose portion of the adapter is not made to resist highly abrasive conditions. Moreover, and especially when considering excavator buckets or loaders, the horizontal width of each tooth assembly needs to be controlled in order to accommodate an adequate number of teeth along a forward edge or lip of the excavating equipment or bucket.

The securement of the excavating or digging tooth to the adapter requires a compromise between two opposing demands. On the one hand, the method of securing the tooth to the adapter must be strong enough to maintain the tooth and adapter in operable relationship notwithstanding the tremendous shock loads encountered during an excavating operation. Yet, when replacement of the tooth is required or desired, the pin for securing the tooth to the adapter must be readily removable. Often times, and especially in field conditions, removal/replacement of the retaining pin is accomplished under rather primitive conditions. Typically, the retaining pin has to be removed with only a hammer and drift pin which makes it difficult to overcome a tightly held locking engagement.

Heretofore, known pinning systems for securing an excavating tooth to an adapter have involved inserting a pin or multiple shorter pins either horizontally or vertically through openings in the tooth and adapter. Vertically oriented pin systems advantageously provide enhanced access to the pin. While providing enhanced access for striking the retaining pin with a hammer, the vertical orientation of the retaining pin exposes the retaining pin to rock and other media being excavated causing pin wear and, in some extreme cases, dislodgement of the retaining pin. Moreover, with vertical pin retention systems, the vertical movements of the excavating equipment tend to work against the vertically oriented pin system causing it to wear and, in some extreme cases, to become dislodged thereby allowing the tooth and adapter to become inadvertently separated during an excavating operation.

Horizontal pinning systems, while allowing for secure attachment of the digging tooth and adapter, also have certain drawbacks associated therewith. As will be appreciated, when secured across a front edge or lip of excavating equipment, the lateral or horizontal spacing between adjacent digging tooth assemblies and/or wear shrouds is minimized. Such tight space constraints make it difficult to horizontally drive a horizontally disposed retaining pin during installation and removal of the digging teeth. In fact, separate industries specifically directed to the problem of driving horizontal retaining pins relative to the digging tooth assembly are known and special devices have been proposed to address the problems inherent with horizontal pinning systems.

Thus, there is a need and a desire for a digging tooth assembly offering enhanced strength characteristics capable of handling extreme loading conditions imparted to the tooth assembly during a excavating operations and whose configuration lends itself to a pinning system which avoids the problems and difficulties associated with heretofore known horizontal and vertical pinning systems.

SUMMARY OF THE INVENTION

In view of the above, and in accordance with the present invention, there is provided a multipiece excavating tooth assembly including an adapter, a digging or excavating tooth, and retaining apparatus for interconnecting said adapter and tooth in operable combination relative to each other. The tooth and adapter have a uniquely configured interface or conjuncture therebetween. Moreover, the conjuncture between the digging tooth and adapter is configured to advantageously orientate the retaining apparatus to avoid those problems inherent with both vertical and horizontal pin systems described above while yielding other heretofore unknown advantages.

The adapter for the multipiece tooth assembly has a base portion and a nose portion axially aligned relative to each other along a longitudinal centerline. The base portion of the adapter is configured to permit attachment of the adapter to excavating equipment. The nose portion of the adapter has top and bottom angled surfaces disposed above and below the longitudinal centerline of the adapter, respectively. At least the top surface on the nose portion of the adapter has two angled sides or facets joined to each other along and diverging relative to a common edge longitudinally extending forwardly from a rear end of and for a lengthwise distance of the nose portion. Each side or facet forming the top surface on the adapter is arranged on opposite lateral sides of the longitudinal centerline of the adapter. The adapter is further configured to accommodate the retaining apparatus used to releasably fasten and hold the digging or excavating tooth and adapter in operable combination relative to each other. In a preferred form, the bottom surface of the nose portion of the adapter has two sides or facets which are likewise joined to each other along and diverging relative to a common edge longitudinally extending forwardly from a rear end of and for a lengthwise distance of the nose portion of the adapter. Like those on the top surface, the sides or facets on the bottom surface of the nose portion of the adapter are arranged on opposite lateral sides of the longitudinal axis of the adapter.

The digging tooth of the excavating tooth assembly has a forward end and a rearward end. The rearward end of the tooth defines a blind cavity or socket configured to accommodate a major lengthwise section of the nose portion of the adapter therewithin. The digging or excavating tooth is further configured to cooperate with the configuration on the adapter for accommodating the pin structure.

The retaining apparatus for holding the adapter and digging tooth in operable combination relative to each other can take a myriad of different designs without detracting or departing from the spirit and scope of the present invention. In one form, the retaining apparatus preferably includes an elongated pin or pin assembly passing endwise through a bore in the adapter and extending at least partially into axially aligned holes defined by the digging tooth. In another form, the retaining apparatus can take the form of a displacable detent or pin which passes into a recess formed on the adapter and extends into releasable association with a recess on the tooth thereby maintaining the digging tooth and adapter in operable association relative to each other.

The adapter and digging tooth of the excavating tooth assembly are preferably configured with supports for stabilizing the tooth assembly during an excavating operation. In a preferred form, the supports for stabilizing the tooth and adapter each include generally horizontal and generally vertical surfaces provided on the top and bottom surfaces of the adapter and corresponding areas of the tooth.

In a preferred form, the two sides forming the top surface on the nose portion of the adapter are downwardly disposed or angled and have a generally planar configuration for adding stability at the conjuncture between the tooth and adapter. Moreover, the two sides of the bottom surface on the nose portion of the adapter are preferably upwardly disposed or angled and likewise have a generally planar configuration to furthermore add stability to the conjuncture between the adapter and digging tooth. To compliment the tooth design which typically embodies a generally wedge shaped profile, the sides or facets of the top and bottom surfaces slope downwardly toward a free end of the nose portion of the adapter such that they are disposed at a converging angle relative to each other. To add strength, durability and rigidity thereto, the adapter is preferably formed as a result of a forging operation.

The nose portion of the adapter is preferably provided with a quadrilaterally shaped cross-sectional configuration. In a preferred embodiment, the four sided nose portion of the adapter has a cross-sectional configuration of an quadrilateral parallelogram. Unlike heretofore known nose portions on other adapters, however, the quadrilaterally shaped cross sectional shape or configuration of the nose portion of a preferred form of the invention is offset at an angle ranging between about 25° to about 65° relative to the orientation of the base portion of the adapter. Preferably, the quadrilateral cross section of the nose portion of the adapter is offset at an angle of about 45° relative to the base portion of the adapter.

With the present design, the common edges joining the sides of the top and bottom surfaces of the nose portion of the adapter can be spaced apart by a first distance which is greater than a second distance separating the diametrically opposed and longitudinally extending common edges joining the sides of the top and bottom surfaces of the nose portion of the adapter arranged to one or the other lateral side of the longitudinal centerline of the adapter. This uniquely configured design enhances the strength of the nose portion of the adapter thereby adding to its durability and operable usefulness.

As is typical, the tip or tooth of the excavating tooth assembly has a generally wedge shaped side profile. The tooth has a ground penetrating edge extending transversely across a forward end thereof to enhance penetration of an earthen surface and which extends generally parallel to an edge or lip of the excavating equipment or bucket to which it is connected. As mentioned above, the rear end of the digging tooth defines a blind cavity which opens to a rear end of the tooth and allows the nose portion of the adapter to be slidably accommodated therewithin. The configuration of the rear end of the tooth and, more specifically, the configuration of the blind cavity at the rear end of the tooth, is preferably configured in a complimentary manner to the configuration of the nose portion of the adapter so as to enhance the conjuncture formed between the tooth and the adapter. The blind cavity defined by the digging tooth includes top and bottom surfaces disposed to opposite sides of a longitudinal centerline of the tooth.

In the illustrated embodiment, the top surface of the cavity in the tooth is defined by two sides or facets; with each side or facet extending at an acute angle ranging between about 25° and about 65° relative to the ground penetrating edge of the tooth. Each angled side forming the top surface of the cavity or socket defined by the tooth is arranged on opposite lateral sides of the longitudinal centerline of the tooth and has a common edge extending therebetween. In a preferred form, the bottom or lower surface of the cavity in the tooth is likewise defined by two sides or facets; with each side or facet extending at an acute angle ranging between about 25° and about 65° relative to the ground penetrating edge of the tooth. Each angled side forming the bottom or lower surface of the cavity or socket defined by the tooth is arranged on opposite lateral sides of the longitudinal centerline of the tooth and has a common edge extending therebetween. The digging tooth furthermore defines a recess configured to accommodate a retaining pin structure defining an axis preferably extending generally normal to one of the sides or facets of the top surface of the blind cavity defined by the tooth.

In a preferred form, the two sides forming the top surface of the blind cavity defined by the tooth have generally planar configurations. Moreover, and in those embodiments so configured, each side defining the bottom surface of the blind cavity of the tooth likewise preferably has a planar configuration. In this preferred design, the blind cavity defined by the tooth has a quadrilaterally shaped cross sectional configuration along a major lengthwise portion thereof. As will be appreciated, the preferable quadrilateral cross-sectional configuration of the cavity defined by the tooth provides any two sides of the top and bottom surfaces to be joined along a common edge. Moreover, in one form, the four sided cavity defined by the tooth has a cross-sectional configuration of an equilateral parallelogram. Notably, the quadrilaterally shaped cross sectional configuration of the cavity is offset at an angle ranging between about 25° and about 65° relative to the transverse ground engaging edge of the tooth. In a most preferred form, the digging tooth is fabricated using a forging process so as to enhance the strength, rigidity and wearability thereof in harsh and demanding environments.

In one form, and to accommodate a retaining apparatus which includes an elongated retainer pin, a bore, defined in the nose portion of the adapter and aligned holes in the digging tooth are complementarily disposed relative to each other to accommodate endwise passage of and thereafter maintain an elongated retaining pin in operable association with the tooth and adapter. In this form, the bore defined by the nose portion of the adapter is disposed along an axis intersecting opposite lateral sides of the top and bottom surfaces of the nose portion of the adapter. According to the present invention, the recess defined by the digging tooth, for accommodating at least a portion of the retaining apparayus therewithin, defines an axis disposed at an angle ranging between about 25° and 65° relative to the forward cutting edge on the tooth.

With the various embodiments of the multiple tooth assemably, the axis of the retaining apparatus preferably extends generally normal to one side or facet of the top surface of the nose portion of the adapter or blind cavity of the tooth, respectively. This slanted or canted orientation of the retaining apparatus offers several heretofore unknown advantages. First, the slanted orientation of the retaining apparatus offers ergonomic advantages during repair and replacement of the digging tooth and especially as involving insertion and removal of the retaining pin structure. Such ergonomic advantages are even more apparent depending upon the disposition of the bucket or implement on which the digging tooth is to be repaired and/or replaced. Moreover, the slanted orientation of the retaining apparatus yields a visual indication of the proper orientation of the digging tooth relative to the adapter during assembly of the digging tooth assembly. As will be appreciated by those skilled in the art, certain digging or excavating teeth are purposefully designed with a specific angle of attack relative to the bucket or ground engaging implement on which it is mounted. Often times, the digging tooth is mounted incorrectly to the bucket, thus, losing the advantages for which it was specifically designed. With the present invention, the slanted orientation of the retaining apparatus provides for proper orientation of the tooth and adapter during assembly thus allowing the user to take full advantage of the benefits specifically designed into the digging tooth.

As described in further detail below, the angular orientation of those components of the digging tooth and adapter forming the conjuncture therebetween have been significantly modified from previous digging tooth assembly designs to purposefully distinguish this design from the prior art while concurrently offering superior strength to the conjuncture therebetween. The angled disposition of the facets forming the top surface of the nose portion of the adapter and the blind cavity in the tooth advantageously promotes a self-centering effect for the loose fit between the tooth and adapter. Additionally, the angled disposition of the facets forming the top surface on the nose portion of the adapter and the top surface of the cavity in the tooth yields an increase in surface area contact (as compared to similarly shaped cross sectional areas oriented or disposed in line with the base portion of the adapter and the leading edge of the tooth) at the conjuncture between the component parts of the tooth assembly thereby adding to the ability of the parts to distribute the loads imparted thereto during ground engaging operations over a broader area.

The angled modification of the component parts forming the conjuncture between the tooth and adapter furthermore advantageously disposes the retaining pin structure at other than a strict and limiting vertical or horizontal orientation. Rather than conform to previous configurations, the angular offset relation offered to the component parts of the conjuncture of the present invention permits the retaining pin to be likewise offset at an angle relative to the horizontal ranging between about 25° and about 65° relative to a horizontal plane thus yielding those advantages mentioned above along with others. That is, with the angular orientation of the retaining apparatus, the materials being excavated and the vertical movements or digging forces of the excavating equipment normally imparted to vertically oriented pin structures will have a significantly lesser adverse effect on the retaining apparatus of the present invention during excavating operations. Another advantage to be appreciated from the new design disclosed by the present invention relates to the enhanced space it provides for substantially unencumbered access to the retaining apparatus as compared to those digging or excavating tooth designs wherein the retaining pin is disposed in a generally horizontal orientation.

These and numerous other objects, aims, and advantages of the present invention will become readily apparent from the following detailed description, the drawings, and the appended claims.

DETAILED DESCRIPTION OF THE DRAWINGS

Figure 6:
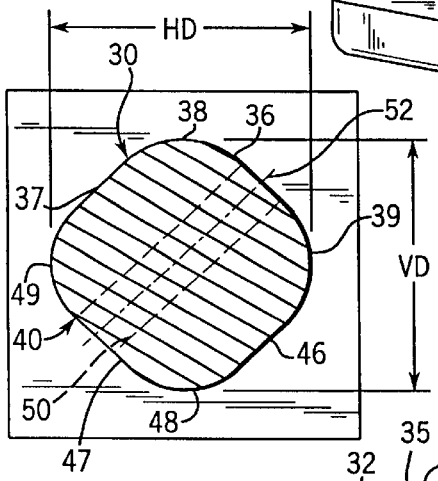
FIG. 6 is a sectional view taken along line 6—6 of FIG. 5.
Figure 26:
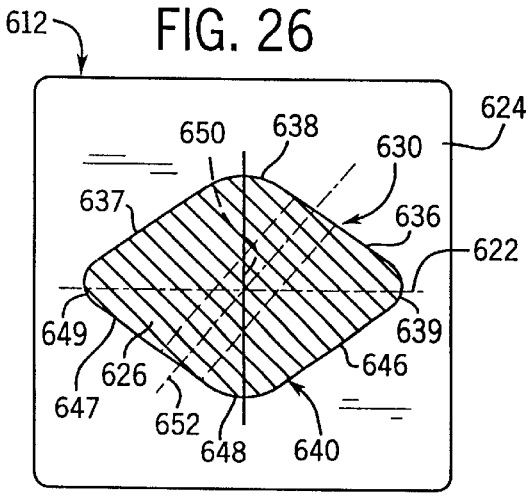
Figure 27:
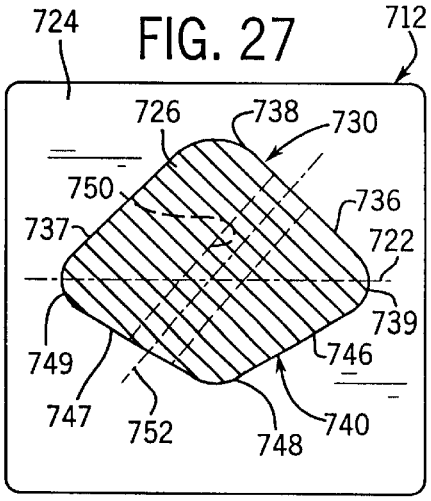
Figure 20:
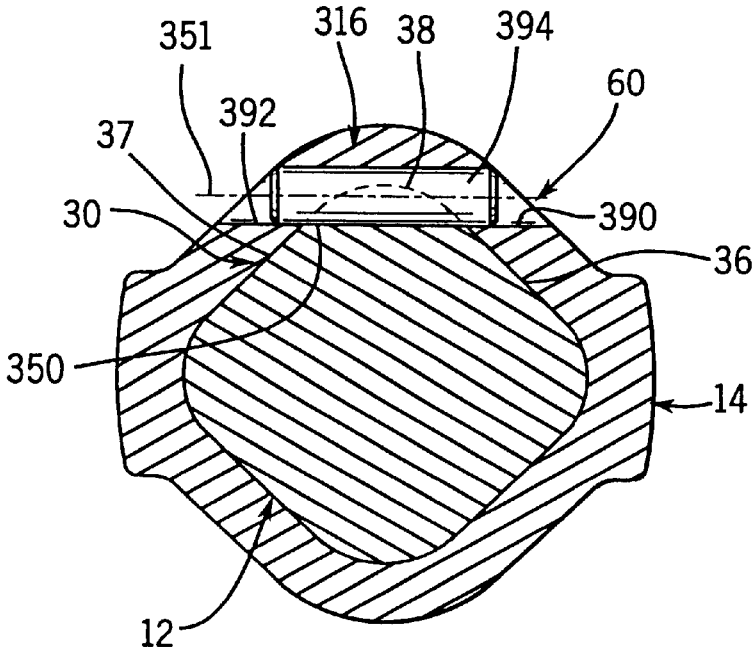
FIG. 20 is a transverse cross-sectional view of a nose portion of an adapter embodying features of the present invention and showing an alternative form of retainer pin structure for releasably fastening a digging tooth in operable association with the adapter.
Figure 24:
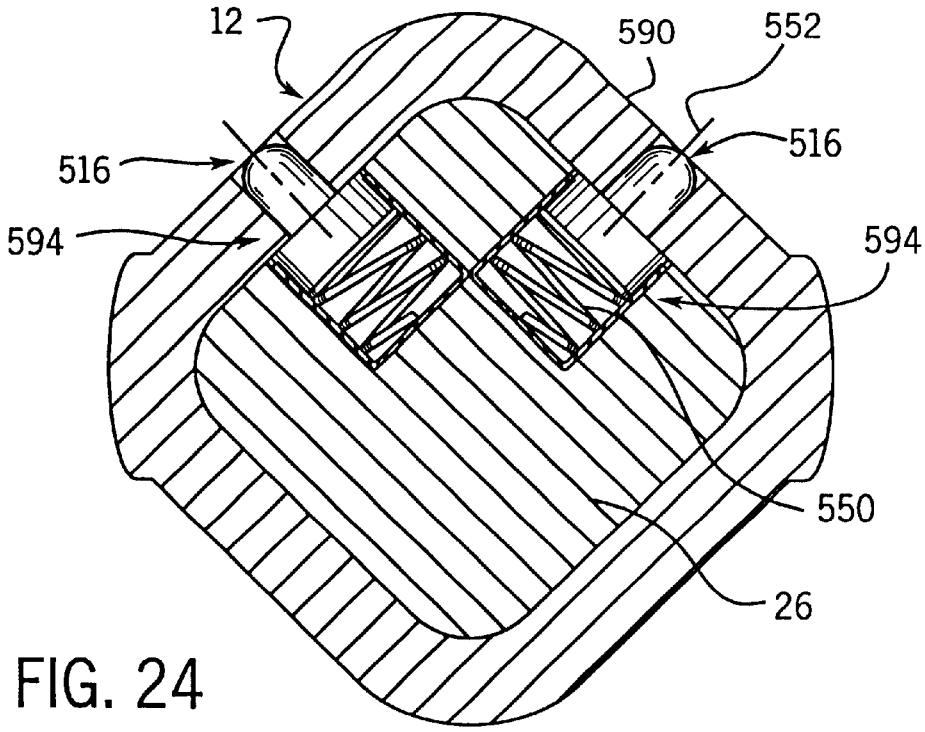
Figure 25:
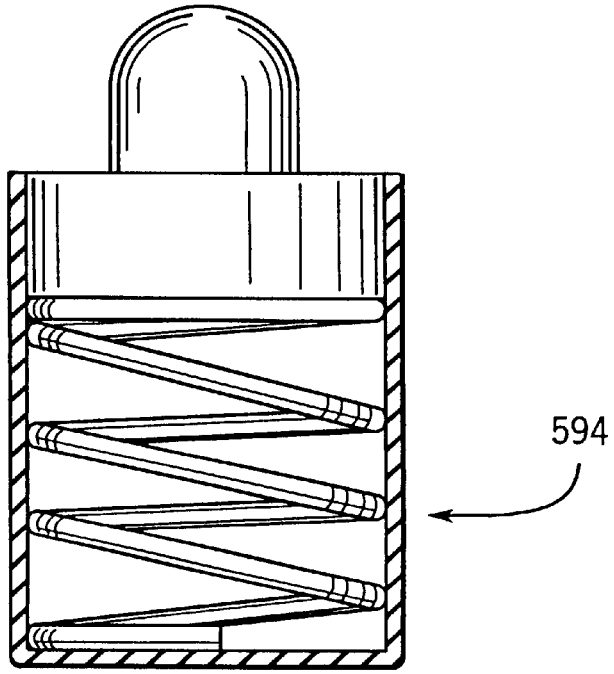
Figure 28:
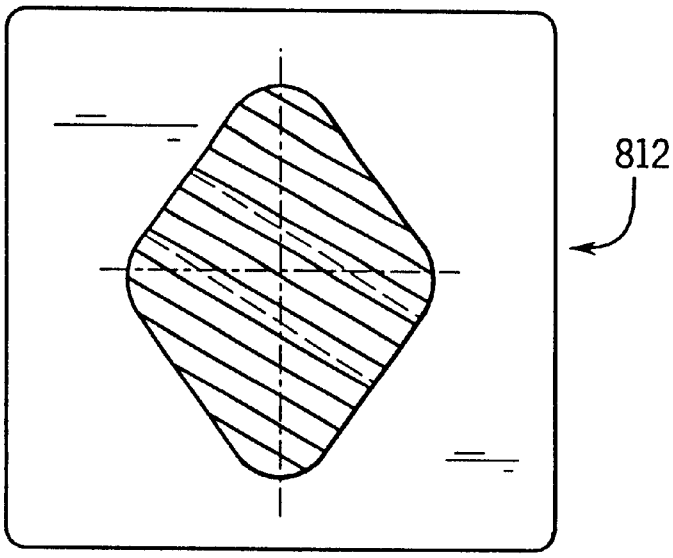
Figure 29:
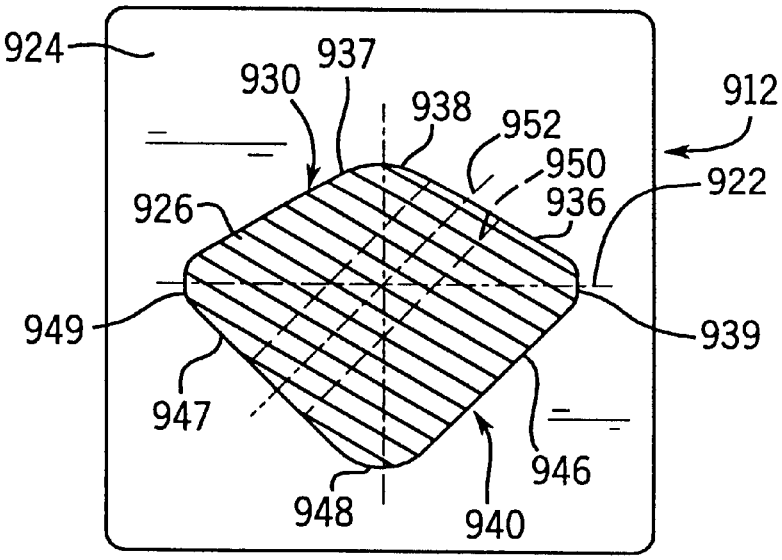
Figure 30:
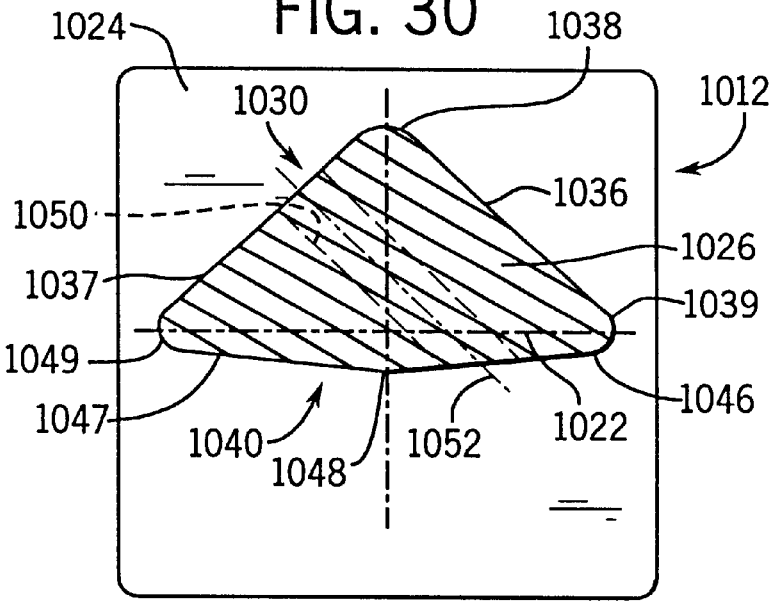
Figure 31:
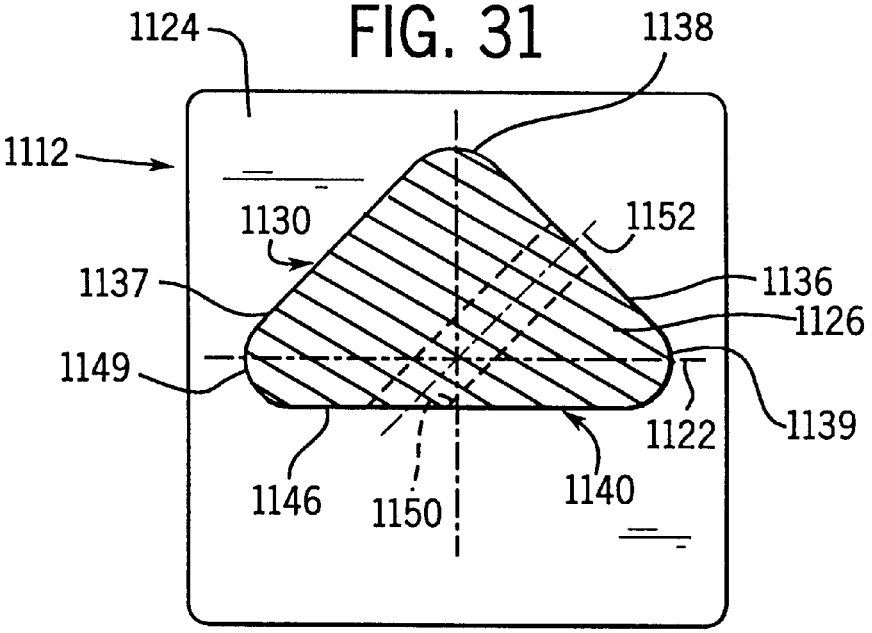

FIG. 24 is an enlarged transverse cross-sectional view similar to FIG. 20 showing a nose portion of an adapter with a digging tooth fitted thereabout and showing still another alternative pin structure for releasably holding and maintaining the adapter and digging tooth in operable combination relative to each other, FIG. 25 is an enlarged side elevational view of the retainer pin structure illustrated in FIG. 24;

FIG. 26 is a sectional view similar to FIG. 6 but showing another alternative cross-sectional configuration for a nose portion of the adapter;

FIG. 27 is another sectional view similar to FIG. 6 but showing still another alternative cross-sectional configuration for a nose portion of the adapter;

FIG. 28 is a sectional view similar to FIG. 6 but showing yet another alternative cross-sectional configuration for a nose portion of the adapter;

FIG. 29 is a sectional view similar to FIG. 6 but showing yet another alternative cross-sectional configuration for a nose portion of the adapter;

FIG. 30 is a sectional view similar to FIG. 6 but showing yet another alternative cross-sectional configuration for a nose portion of the adapter; and FIG. 31 is another sectional view similar to FIG. 6 but showing yet another alternative cross-sectional configuration for a nose portion of the adapter.

DETAILED DESCRIPTION OF THE PRESENT INVENTION

While the present invention is susceptible of embodiment in multiple forms, there are shown in the drawings and will hereinafter be described various preferred embodiments of the present invention with the understanding the present disclosure is to be considered as setting forth exemplifications of the invention which are not intended to limit the invention to the specific embodiments illustrated and described.

Figure 1:
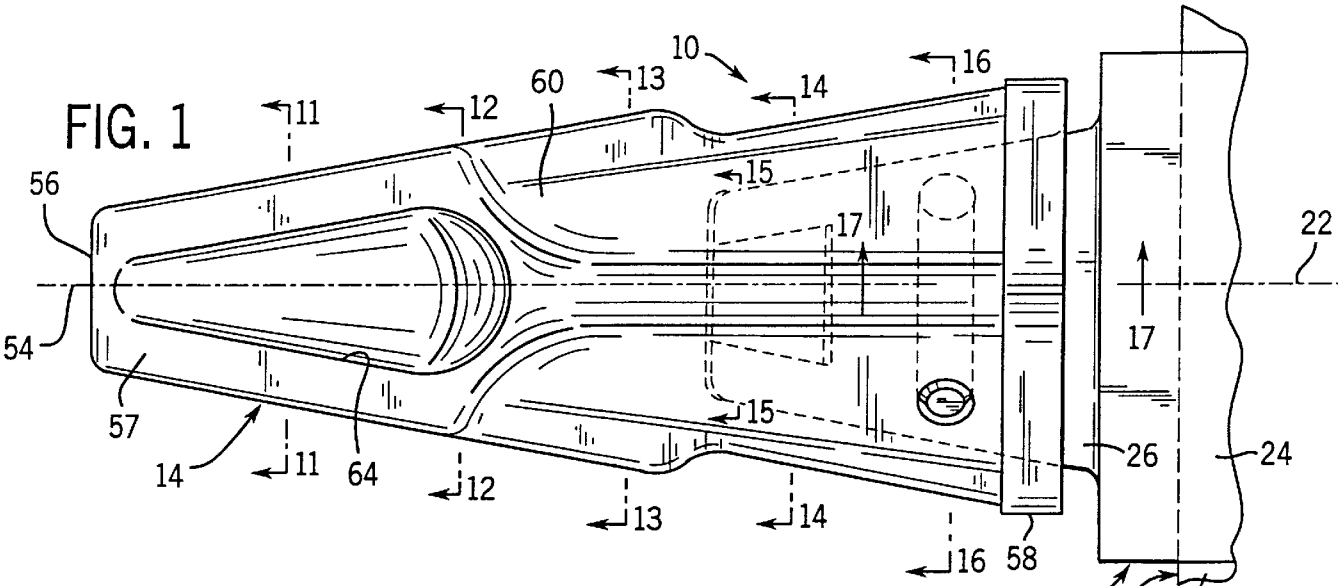
FIG. 1 is a top plan view of the excavating tooth assembly of the present invention.
Figure 2:
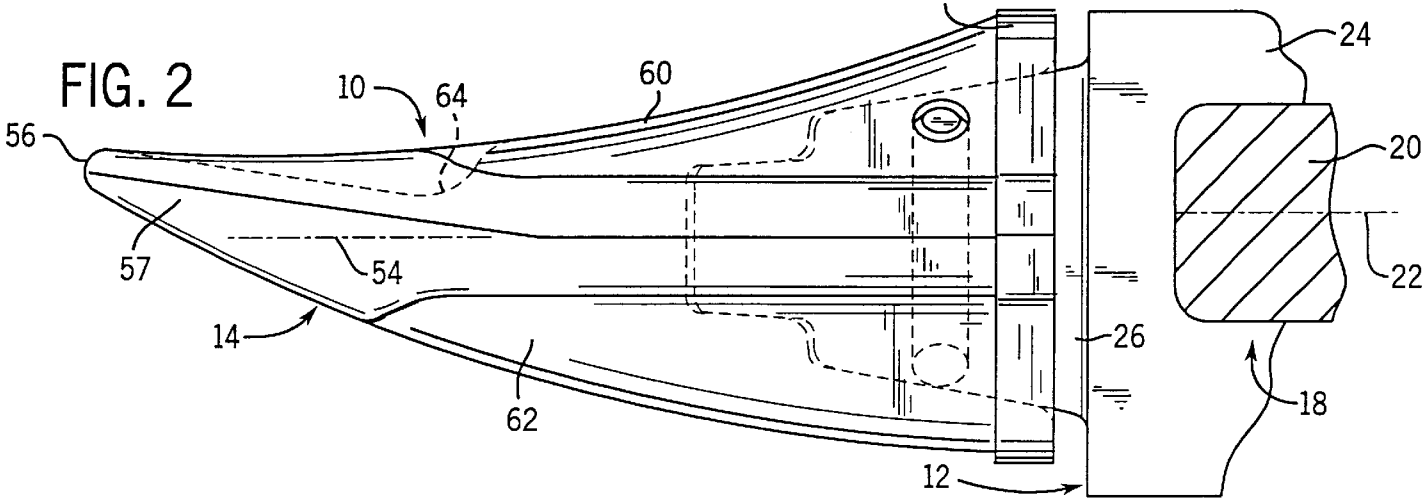
FIG. 2 is a side elevational view of the excavating tooth assembly illustrated in FIG. 1.

Referring now to the drawings, wherein like reference numerals indicate like parts throughout the several views, there is illustrated in FIG. 1 an excavating tooth assembly 10. As shown, the excavating tooth assembly 10 is of multiple piece construction and includes an adapter or support 12 and an excavating tooth 14 held in one position or orientation relative to each other. In the embodiment illustrated in FIG. 1, a retainer apparatus 16 releasably interconnects and maintains the adapter 12 and excavating tooth 14 in operable combination relative to each other.

Although only a single excavating tooth assembly is shown in FIG. 1 as being attached to excavating equipment 18, such as a forward lip 20 of an excavating bucket or the like, it will be understood by those skilled in the art that on a typical piece of excavating equipment, a plurality of laterally spaced tooth assemblies, substantially identical to tooth assembly 10, would extend forwardly from the bucket lip 20 in a ground engaging orientation. Moreover, and as will be appreciated by those skilled in the art, the bucket, shovel or other piece of excavating equipment to which the excavating tooth assembly 10 is connected moves both vertically and horizontally during an excavating operation.

As illustrated in FIGS. 1 through 4, the adapter or support 12 has an elongated free ended configuration defining a longitudinal centerline 22. The adapter or support 12 includes a conventional base portion 24 and an axially aligned nose portion 26 extending forwardly from the base portion 24 in a cantilevered fashion from the forward edge or lip 20 of the ground excavating apparatus or bucket 18. The base portion 24 of the adapter 12 is configured for attachment to the ground engaging apparatus 18. On some larger forms of equipment, the base portion 24 of the adapter 12 is configured for releasable securement, such as by a conventional wedge locking mechanism (not shown), to the forward lip 20 of the shovel or dipper bucket 18 of the earth excavation apparatus. As is typical, the excavating tooth 14 fits endwise along and about the nose portion 26 of the adapter 12. In a preferred form, the adapter 12 is formed as a result of a forging operation thereby adding strength and rigidity to the adapter 12.

Figure 3:
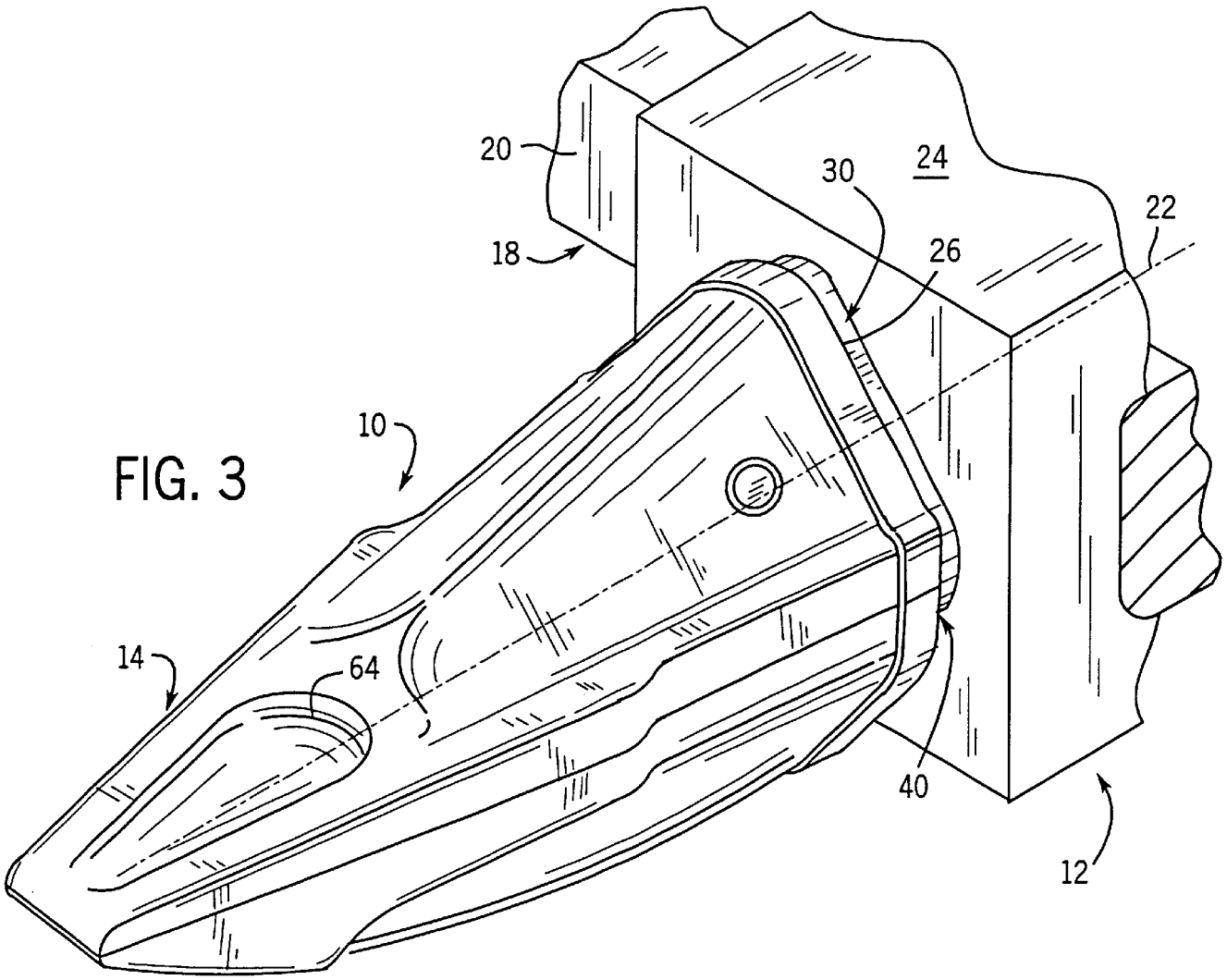
FIG. 3 is a perspective view of the excavating tooth assembly of the present invention.
Figure 7:
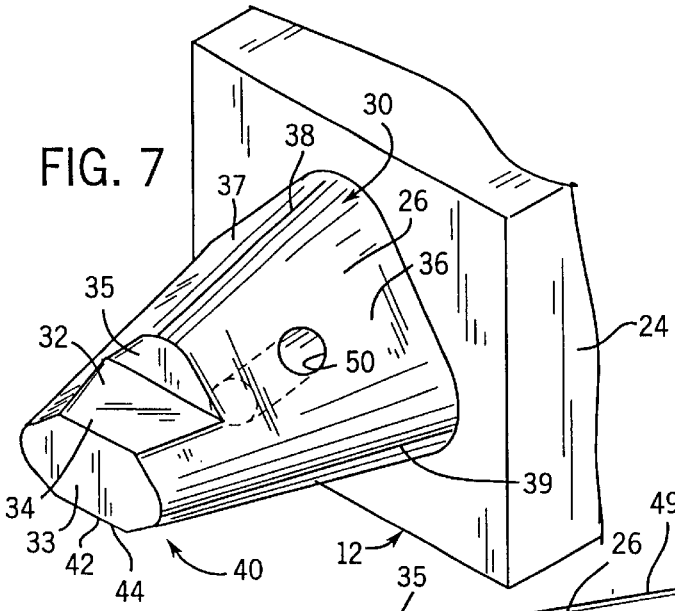
FIG. 7 is a perspective view of the adapter illustrated in FIGS. 4 through 6.
Figure 4:
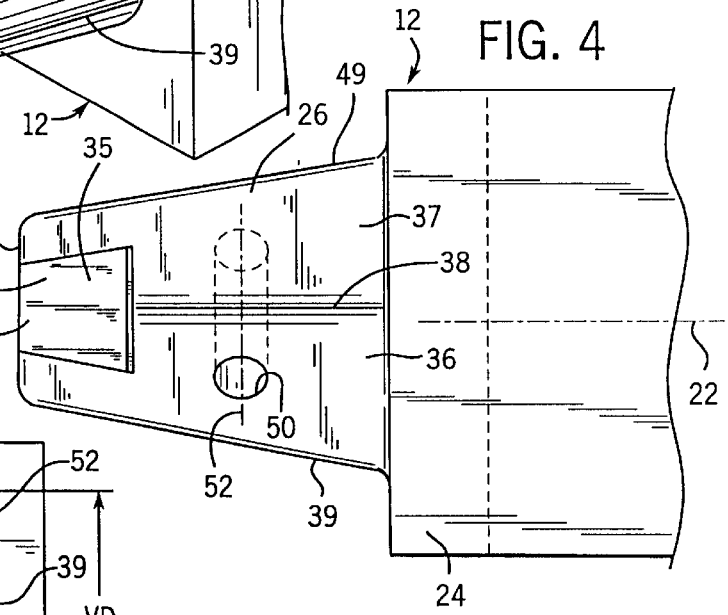
FIG. 4 is a top plan view of the adapter forming part of the excavating tooth assembly.
Figure 5:
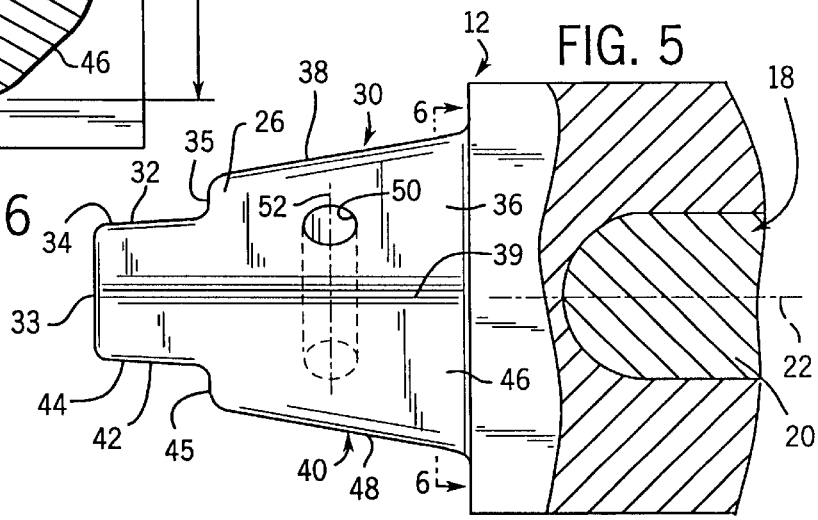
FIG. 5 is a side elevational view, partly in section, of the adapter illustrated in FIG. 4.
Figure 8:
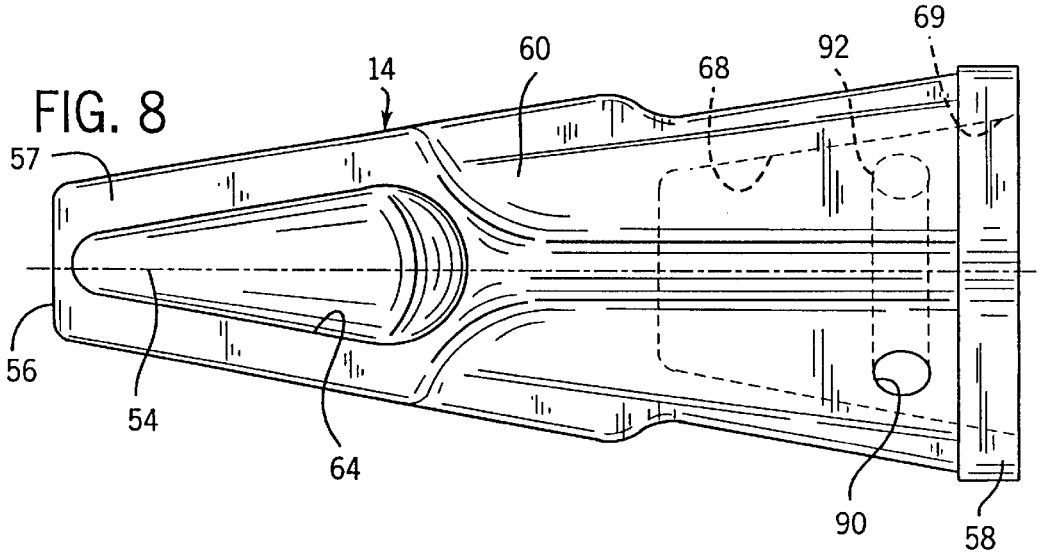
FIG. 8 is a top plan view of the excavating tooth forming part of the excavating tooth assembly of the present invention.

As shown in FIGS. 3, 4 and 5, the nose portion 26 of the adapter 12 has a forwardly tapered configuration including angularly converging top and bottom surfaces exterior surfaces 30 and 40, respectively. The top and bottom surfaces 30 and 40, respectively, are disposed generally above and below, respectively, the longitudinal centerline 22 of the adapter 12. In a preferred form, and as shown in FIGS. 4, 5 and 7, the exterior top and bottom surfaces 30, 40, respectively, of the adapter 12 are each provided with a recessed area 32, 42, respectively, arranged toward a terminal end region 33 of the adapter 12. Preferably, the recessed areas 32, 42 are equally disposed on the surfaces 30, 40 and relative to the longitudinal centerline 22 of the adapter 12. Each recessed area 32, 42 defines a stabilizing surface or land on the surfaces 30, 40 of the adapter 12.

Each land 32, 42 protrudes inwardly from the respective slanted surface 30, 40 on the adapter 12 to define a generally flat or horizontal surface 34, 44 extending generally parallel to the longitudinal centerline 22 of the adapter 12. As will be appreciated, a predetermined vertical distance is measurable between the flats or generally horizontal surfaces 34, 44 on the top and bottom surfaces 30, 40 of the adapter 12. Moreover, each land 32, 42 includes a generally vertical stabilizing wall 35, 45, respectively. As will be described below, the lands 32, 42 on the top and bottom surfaces 30 and 32, respectively, of the adapter 12 provide greater load distribution to absorb extreme vertical loads commonly imparted to the tooth assembly during an excavating operation while the vertical stabilizing walls 35, 45 on each stabilizing land 32, 42, respectively, provide additional vertical bearing surfaces to assist in absorbing extreme horizontal loads which are likewise commonly imparted to the tooth assembly during an excavating operation.

The nose portion 26 of the adapter 12. As shown in FIGS. 4, 6 and 7, the top surface 30 of the adapter 12 has two downwardly disposed and angled sides or facets 36 and 37 joined to each other along a common top edge 38 extending forwardly along the adapter 12 from the base portion 24. As shown, the angled sides or facets 36, 37 forming the top surface 30 of the adapter 12 are arranged on opposite lateral sides of the longitudinal centerline 22 of the adapter 12. The common top edge 38 joining the two sides 36, 37 extends for a major length of the adapter 12 and is generally centrally disposed along the longitudinal centerline 22 thereof. In a preferred form the angled sides 36, 37 forming the top surface 30 of the adapter 12 slant or slope longitudinally downward toward the free end of the nose portion 26 of the adapter 12.

In a preferred from, the downwardly disposed sides 36, 37 forming the top surface 30 of the adapter 12 each have a generally planar configuration. In this form, the sides 36, 37 forming the top surface of the adapter 12 are each slanted at an angle of about 45° relative to a horizontal plane and the common top edge 38 is formed at the intersection of those planes defined by and along the planar configurations of the angled sides 36, 37. As illustrated in FIG. 6, the common top edge 38 preferably has a radiused or curved configuration.

In a preferred form, and as best shown in FIG. 6, the bottom surface 40 of the adapter 12 has a complementary configuration relative to the top surface 30. That is, the bottom or lower surface 40 of the adapter 12 has two upwardly disposed and angled sides or facets 46 and 47 joined to each other along a common bottom or lower edge 48 and extending forwardly along the adapter 12 from the base portion 24. As shown, the angled sides or facets 46, 47 forming the bottom surface 40 of the adapter 12 are arranged on opposite lateral sides of the longitudinal centerline 22 of the adapter 12. The common lower or bottom edge 48 joining the two angled sides 46, 47 extends for a major length of the adapter 12 and is generally centrally disposed along the longitudinal centerline 22 thereof. In a preferred form, the sides 46, 47 of the bottom surface 40 slant or slope longitudinally downward toward the free end of the nose portion 26 of the adapter 12.

In a preferred form, the sides 46, 47 forming the bottom or lower surface 40 of the adapter 12 each has a generally planar configuration. In this form, the sides 46, 47 forming the top surface of the adapter 12 are each slanted at an angle of about 45° relative to a horizontal plane and the common top edge 38 is formed at the intersection of those planes defined by and along the planar configurations of the angled sides 36, 37. As illustrated in FIG. 6, the common top edge 38 preferably has a radiused or curved configuration.

In that embodiment wherein the sides 36, 37 forming the top surface 30 and the sides 46, 47 forming the lower or bottom surface 40 of the adapter 12 are configured with generally planar configurations, as shown in FIG. 6, the nose portion 26 of the adapter 12 is provided with a generally rectangular or quadrilaterally shaped cross-sectional configuration for a major lengthwise longitudinal distance thereof. The four sided nose portion 26 of the adapter 12 preferably has a cross-sectional configuration of an equilateral parallelogram. Because the sides 36, 37 and 46, 47 of the top and bottom surfaces 30 and 40, respectively, converge toward the terminal end of the adapter 12, the rectangular or quardrilaterally shaped cross-sectional configuration of the nose portion 26 of the adapter 12 increases as a function of the distance measured rearwardly from the free terminal end 33 thereof. Notably, however, the nose portion 26 of the adapter 12 preferably maintains an equilateral parallelogram cross-sectional configuration between the sides 36, 37 and 46, 47 thereof for the length thereof.

In one embodiment, the angularly disposed sides 36 and 46 forming the top and bottom surfaces 30 and 40, respectively, which are disposed to one side of the longitudinal centerline 22 of the adapter 12, are likewise joined to each other along a common side edge 39 extending longitudinally forward from the base portion 24 of the adapter 12. The common side edge 39 is formed at the intersection of those planes defined by and along the planar configurations of the angled sides 36, 46. As illustrated in FIG. 6, the common side edge 39 preferably has a radiused or curved configuration. Similarly, with the embodiment illustrated in FIG. 6, the angularly disposed. Similarly, with the embodiment of the invention illustrated in FIG. 6, the angularly disposed sides 37 and 47 of the top and bottom surfaces 30 and 40, respectively, arranged on an opposite side of the longitudinal axis 22 of the adapter 12 are joined to each other along a common side edge 49 extending longitudinally forward from the base portion 24 of the adapter 12. The common side edge 49 is formed at the intersection of those planes defined by and along the planar configurations of the angled sides 37, 47. As illustrated in FIG. 6, the common side edge 49 preferably has a radiused or curved configuration. As will be appreciated, the quadrilateral cross-sectional configuration of the nose portion 26 of the adapter 12 preferably provides any two sides 36, 37 and 46, 47 of the top and bottom surfaces 30, 40, respectively, of the adapter 12 to be joined along a common edge.

In the embodiment illustrated in FIG. 6, a major lengthwise section of the nose portion 26 of the adapter 12 is offset at an angle of about 45° relative to the base portion 24 of the adapter 12. As such, the vertical distance VD measurable across the adapter 12 and between the common top and bottom edges 38 and 48 on the top and bottom surfaces 30 and 40, respectively, is significantly greater than the distance measurable across either of the two opposed sides on the top and bottom surfaces 30, 40, respectively, of the adapter 12. Similarly, the horizontal distance HD measurable across the adapter 12 and between the common side edges 39 and 49 on the top and bottom surfaces 30 and 40, respectively is significantly greater than the distance measurable across either of the two opposed sides on the top and bottom surfaces 30 and 40, respectively, of the adapter 12.

The nose portion 26 of the adapter 12 further defines a recess or aperture 50 for accommodating the retaining apparatus 16. In the embodiment illustrated in FIGS. 1 through 7, the recess or bore 50 extends through the adapter 12 and has opposed open ends. As illustrated in FIG. 6, the bore or recess 50 is disposed along an axis 52 which intersects opposite sides 36, 47 of the top and bottom surfaces 30 and 40, respectively, disposed on opposite lateral sides of the longitudinal axis of the adapter 12. In the illustrated embodiment, the axis 52 of the recess or bore 50 is disposed at an angle of about 45° relative to a horizontal plane. In a most preferred form, and to facilitate fabrication of the adapter 12, the axis 52 of the recess or bore 50 extends generally normal to at least one of the sides forming the top and bottom surfaces 30, 40 of the adapter 12. As will be appreciated by those skilled in the art, the bore 50 will be sized and configured to accommodate the elongated fastener 16 serving to releasably hold the adapter 12 and excavating tooth 14 in operable combination relative to each other.

When the multi-piece excavating tooth 10 is assembled, the excavating tooth 14 is configured for endwise accommodation along and about a lengthwise section of the nose portion 26 of the adapter 12. As shown in FIGS. 1, 2, 8 and 9, the excavating tooth 14 has an elongated wedge-like configuration defining a centerline 54 with a lateral cutting or ground penetrating edge 56 extending transversely across a forward end portion 57 and provided with a hollow rear mounting end 58. When assembled to the adapter 12, the cutting or ground penetrating edge 56 extends generally horizontal and, thus, generally parallel with the edge or lip 20 (FIG. 1) of the excavating equipment to which it is operably connected. As will be appreciated by those skilled in the art, the hollow mounting end portion 58 allows the tooth 14 to be fitted endwise onto the adapter 12. In a preferred form, the tooth 14 is formed as a result of a forging operation, thus, enhancing the strength and rigidity thereof.

Figure 13:
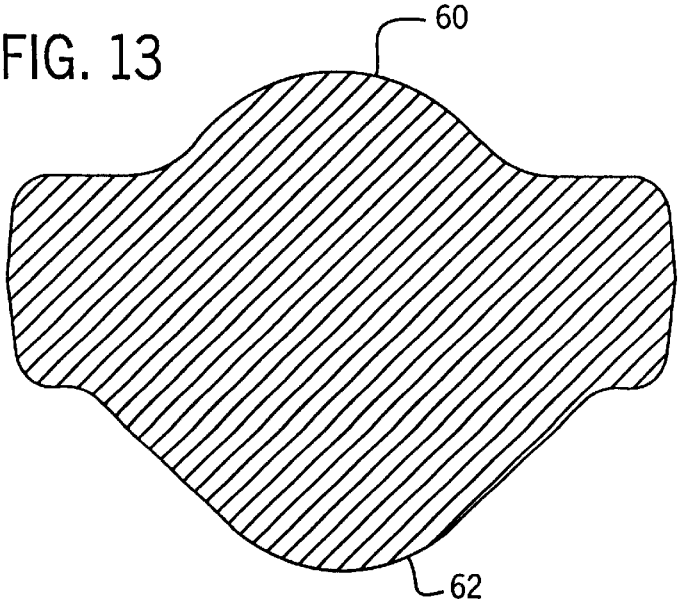
FIG. 13 is a sectional view taken along line 13—13 of FIG. 1.
Figure 14:
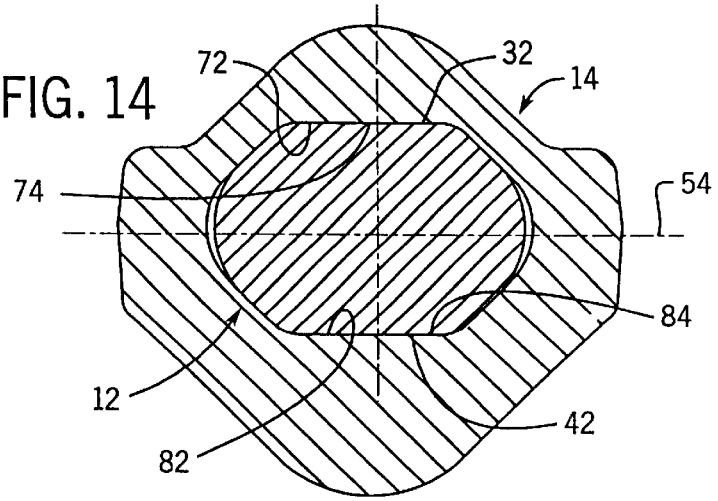
FIG. 14 is a sectional view taken along line 14—14 of FIG. 1.
Figure 15:
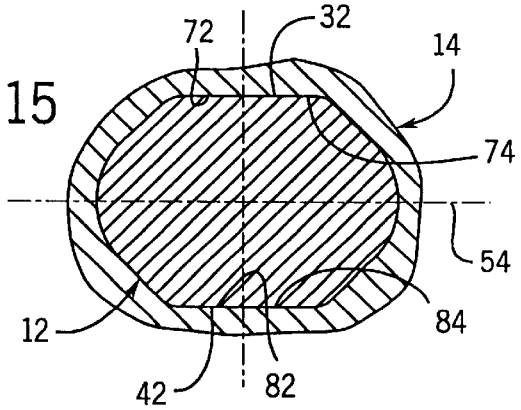
FIG. 15 is a sectional view taken along line 15—15 of FIG. 1.

As shown, the tooth 14 includes upper and lower exterior surfaces 60 and 62, respectively, extending rearwardly from the forward cutting edge 56 and extending toward the rear end 59 of the tooth 14. As the surfaces 60, 62 extend rearwardly from the edge 56, they angularly diverge away from each other. As shown in FIGS. 8, 9, 11 and 12, the top or upper exterior surface 60 of the tooth 14 is configured with a specifically configured recess 64 extending rearwardly from the lateral edge 56 (FIG. 1) for inhibiting blunting of the tooth 14 as a result of wear thereto. As shown in FIG. 13, the cross-sectional configuration of the tooth 14, and the top surface 60 thereof, significantly changes as a function of the distance measured rearwardly from the cutting edge 56 (FIG. 1) thereof.

Figure 9:
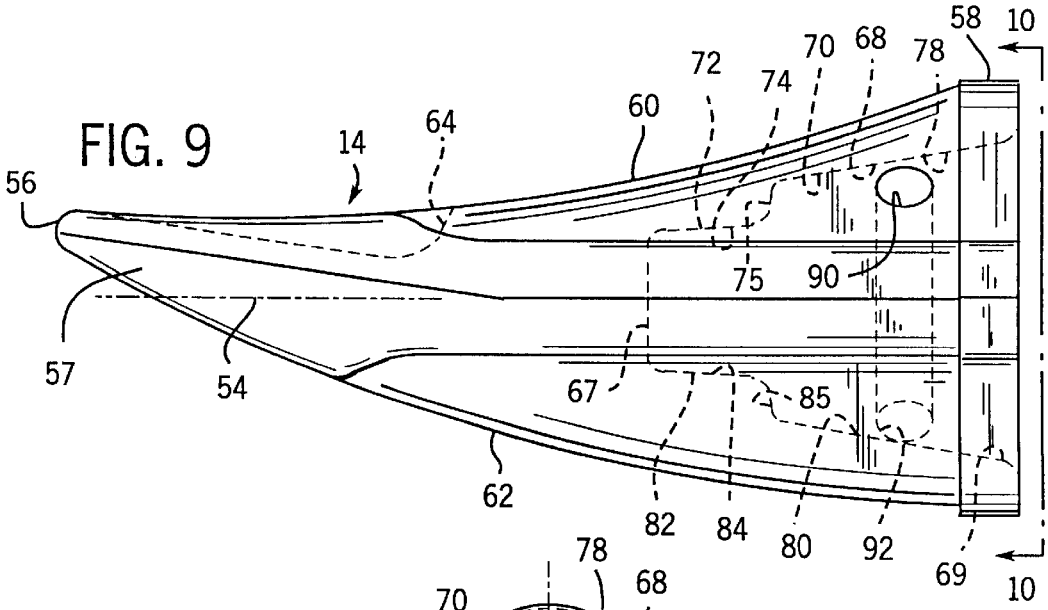
FIG. 9 is a side elevational view of the excavating tooth illustrated in FIG. 8.
Figure 10:
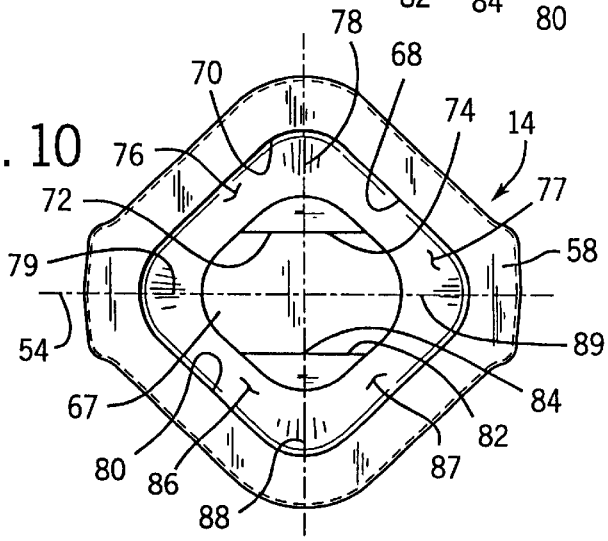
FIG. 10 is a rear view of the excavating tooth illustrated in FIG. 8.
Figure 11:
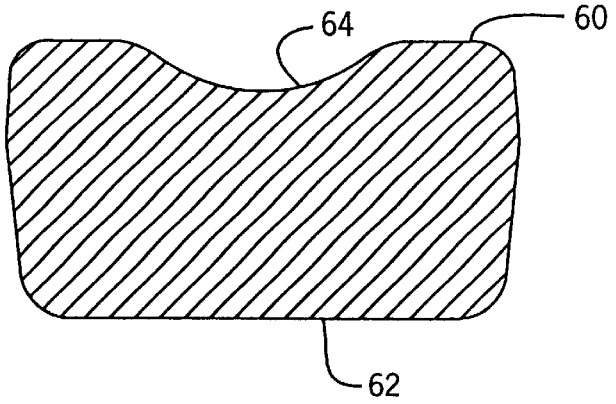
FIG. 11 is a sectional view taken along line 11—11 of FIG. 1.
Figure 12:
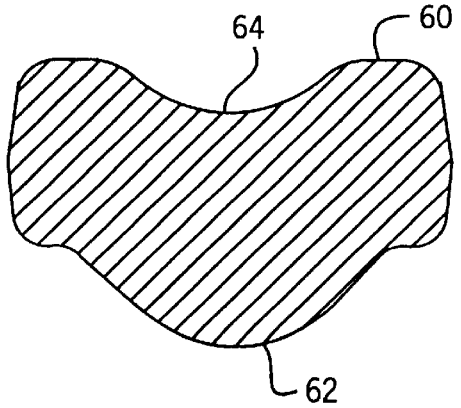
FIG. 12 is a sectional view taken along line 12—12 of FIG. 1.

As is conventional in multi-piece tooth assemblies of the type hereunder consideration, and as shown in FIG. 10, the rear portion 58 of the tooth 14 defines a blind cavity or socket 68 opening to the rear end of the tooth 14. In a preferred form, and as shown in FIG. 9, the edge of the cavity 68 opening to rear end 58 has an inwardly directed radius 69 extending thereabout to facilitate and guide endwise insertion of the nose portion 26 of the adapter 12 into a mating conjunctive relationship or fit with the tooth 14.

As illustrated in FIGS. 9 and 10, the cavity 68 defined by the tooth 14 includes top and bottom interior surfaces 70 and 80, respectively, extending forwardly from the open rear end of the cavity 68 toward the forward edge 56 of the tooth 14 and angularly converge toward each other at substantially the same angle the top and bottom surfaces 30 and 40, respectively, are disposed on the nose portion 26 of the adapter 12. The top and bottom interior surfaces 70, 80 terminate in an end wall 67. The top and bottom surfaces 70 and 80, respectively, are disposed generally above and below, respectively, the longitudinal centerline 54 of the tooth 14. In a preferred form, the interior top and bottom surfaces 70 and 80, respectively, defined by cavity or socket 68 of tooth 14 furthermore include a pair of stabilizing lands 72 and 82, respectively, arranged toward and extending rearwardly from the terminal end wall 67 of the cavity 68. The stabilizing lands 72, 82 are disposed and configured to mate with the lands 32, 42, respectively, on the nose portion 26 when the adapter 12 and tooth 14 are arranged in operable combination relative to each other.

As illustrated in FIGS. 9, 10, 14 and 15, each stabilizing land 72, 82 protrudes inwardly from the top and bottom surface 70, 80, respectively, toward the centerline 54 of the tooth 14 to define generally flat or horizontal surfaces 74, 84 extending generally parallel to the centerline 54 of the tooth 14. As will be appreciated, a predetermined vertical distance is measurable between the flat or generally horizontal surfaces 74, 84 on the top and bottom surfaces 70, 80, respectively, of cavity 68 defined by tooth 14. Moreover, each stabilizing land 72, 82 includes a generally vertical stabilizing wall 75, 85, respectively.

When the adapter 12 and tooth 14 are arranged in operable combination relative to each other, the lands 72, 82 on the tooth 14 combine with the lands 32, 42 on the nose portion 26 of the adapter 12 to absorb and distribute extreme vertical loads commonly imparted to the tooth assembly 10 during an excavating operation. Moreover, the stabilizing walls 75, 85 on the top and bottom surfaces 70, 80, respectively, of the cavity 68 defined by tooth 14 operably combine with the stabilizing walls 35, 45 (FIG. 5) on the adapter 12 to provide additional bearing surfaces to assist in distributing an absorbing extreme horizontal loads commonly imparted to the tooth assembly 10 during normal excavating operations.

To enhance the conjuncture between the adapter 12 and tooth 14, the cavity 68 defined by tooth 14 also has a unique configuration. As shown in FIG. 10, the top surface 70 defining a portion of cavity 68 has two downwardly disposed sides 76 and 77 joined to each other along a common top edge 78 extending forwardly from the open end of the cavity 68. As shown, the angled sides 76, 77 defining the top surface 70 of cavity 68 are arranged on opposite lateral sides of the longitudinal centerline 54 of the tooth 14. The common top edge 78 joining the two sides 76, 77 of the top surface 70 of cavity 68 extends for a major length of the cavity 68 and is generally centrally disposed relative to the longitudinal centerline 54 of tooth 14. In a preferred form, the sides 76 and 77 defining the top surface 70 of the cavity longitudinally slope or slant downwardly toward the terminal wall 67 of cavity 68.

In a preferred form, the sides 76, 77 forming the top surface 70 of cavity 68 defined by tooth 14 each have a generally planar configuration. In this form, the sides 76, 77 forming the top surface 70 of cavity 68 are each slanted at an angle of about 45° relative to the forward cutting edge 56 of the tooth 14 and the common top edge 78 is formed at the intersection of those planes defined by and along the planar configurations of the angled sides 76, 77 forming the top surface 70 of the cavity 68. As illustrated in FIG. 6, the common top edge 78 preferably has a radiused or curved configuration.

In that embodiment illustrated in FIG. 10, the bottom surface 80 forming part of cavity 68 as a complementary configuration relative to the top surface 70 of cavity 68 defined by tooth 14. That is, the bottom or lower surface 80 forming cavity 68 has two upwardly disposed sides 86 and 87 joined to each other along a common bottom edge 88 extending forwardly from the open end of the cavity 68 defined by tooth 14. As shown, the angled sides 86, 87 forming the bottom or lower surface 80 of cavity 68 are arranged on opposite lateral sides of the longitudinal centerline 54 of the tooth 14. The lower or bottom common edge 88 joining the sides 86 and 87 of cavity 68 extends for a major length of the cavity and is generally centrally disposed relative to the longitudinal centerline 54 of the tooth 14.

In a preferred form, the sides 86, 87 forming the bottom or lower surface 80 of cavity 68 defined by tooth 14 each have a generally planar configuration. In this form, the sides 86, 87, forming the top surface 80 of cavity 68, are each slanted at an angle of about 45° relative to the forward cutting edge 56 of the tooth 14 and the common bottom edge 88 is formed at the intersection of those planes defined by and along the planar configurations of the angled sides 86, 87 forming the bottom surface 80 of the cavity 68. As illustrated in FIG. 6, the common bottom edge 88 preferably has a radiused or curved configuration.

In that embodiment wherein the sides 76, 77 forming the top surface 70 of cavity 68 and the sides 86, 87 forming the lower or bottom surface 80 of the cavity 68 are configured with generally planar surfaces, as shown in FIG. 10, the cavity 68 is provided with a generally rectangular or quadrilateral cross-sectional configuration along a major lengthwise portion thereof. The four sided cavity 68 defined by the tooth 14 preferably has a cross-sectional configuration of an equilateral parallelogram. Because the sides 76, 77 of the top surface 70 and the sides 86, 87 forming the bottom surface 80 of cavity 68 each slope toward the terminal wall 67, the cross-sectional configuration of the cavity 68 decreases in area as measured forwardly from the rear open end 58 thereof. Notably, however, and for a major lengthwise distance thereof, the cavity 68 defined by tooth 14 preferably maintains an equilateral parallelogram cross-sectional configuration between the sides 76, 77 and 86, 87 thereof. Moreover, and as shown in that embodiment illustrated in FIG. 10, the cavity 68 is offset relative to the forward cutting or penetrating edge at an angle of about 45°.

In the embodiment illustrated in FIG. 10, the angularly disposed sides 76 and 86 partially forming the top and bottom surfaces 70 and 80, respectively, of cavity 68 and which are disposed to one side of the longitudinal centerline 54 of tooth 14 are likewise joined to each other along a common side edge 79 extending longitudinally forward from the open end of the cavity 68 defined by tooth 14. The common side edge 79 is formed at the intersection of those planes defined by and along the planar configurations of the angled sides 76 and 86 of the cavity. As illustrated in FIG. 10, the common side edge 79 preferably has a radiused or curved configuration. Similarly, with the embodiment illustrated in FIG. 10, the angularly disposed sides 77 and 87 partially forming the top and bottom surfaces 70 and 80, respectively, of cavity 68 and which are disposed to an opposite side of the longitudinal centerline 54 of tooth 14 are joined to each other along a common side edge 89 extending longitudinally forward from the open end of the cavity 68 defined by tooth 14. The common side edge 89 is formed at the intersection of those planes defined by and along the planar configurations of the angled sides 77, 87 of cavity 68. As illustrated in FIG. 10, the common side edge 89 preferably has a radiused or curved configuration. As will be appreciated, the quadrilateral cross-sectional configuration of the cavity 68 defined by tooth 14 preferably provides any two sides 76, 77 and 86, 87 of the top and bottom surfaces 70, 80, respectively, of the cavity 68 defined by tooth 14 to be joined along a common edge.

Figure 16:
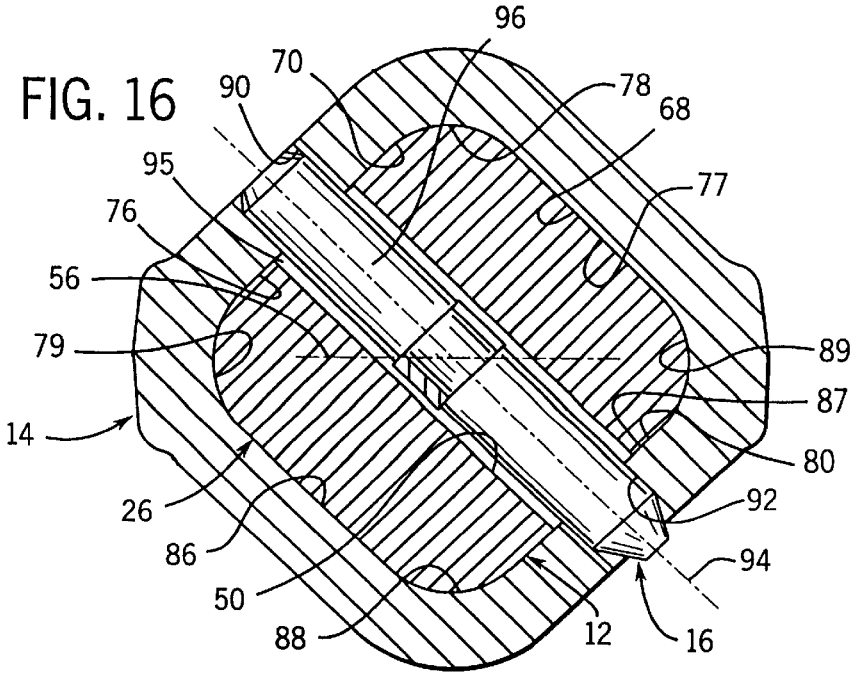
FIG. 16 is a sectional view taken along line 16—16 of FIG. 1.
Figure 17:
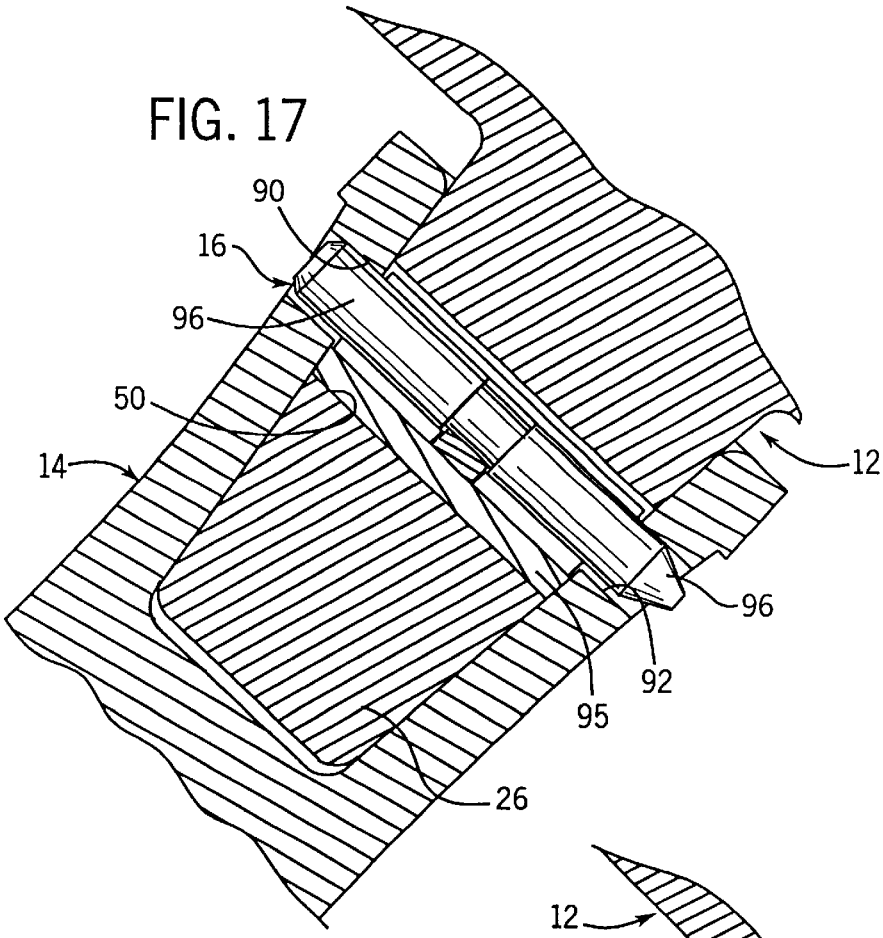
FIG. 17 is a sectional view taken along line 17—17 of FIG. 1.

To coact with that embodiment of adapter 12 illustrated in FIG. 3, excavating or digging tooth 14 is furthermore recessed to accommodate a lengthwise portion of the retainer apparatus 16. In the embodiment illustrated in FIGS. 8, 9, 16 and 17, the recessed tooth 14 defines a pair of axially aligned throughholes or openings 90 and 92. As illustrated in FIG. 16, the holes 90, 92 are aligned about an axis 94 which intersects diametrically opposed sides 76 and 87 of the top and bottom surfaces 70 and 80 and passes through the cavity 68 defined by tooth 14. In the illustrated form of the invention, the axis 94 defined by holes 90, 92 of tooth 14 is disposed at an angle of about 45° relative to the ground engaging or penetrating edge 56 of the tooth 14. The holes or openings 90, 92 in the tooth 14 are configured to accommodate endwise passage of a conventional elongated retainer pin which is exemplary of but one form of retaining apparatus or fastener 16 used to permit the adapter 12 and tooth 14 to be releasably interconnected in operable relationship relative to each other. As will be appreciated by, and as known to those skilled in the art, the fore-and-aft relationship of the holes 90, 92 in the tooth 14 and the bore 50 in the nose portion 26 of the adapter 12 are arranged such that the elongated retainer pin is maintained in locked relationship relative to the adapter 12 and tooth 14 so as to inhibit inadvertent endwise displacement thereof The retaining or apparatus 16 for releasably interconnecting and maintaining the adapter 12 and tooth 14 in operable combination relative to each other can take a myriad of different forms without detracting or departing from the spirt and scope of the present invention. In one form, the retaining apparatus 16 can be of the type disclosed in coassigned U.S. Pat. No. 5,765,301 granted Jun. 16, 1998; the full disclosure of which is incorporated herein by reference. Suffice it to say, in the embodiment illustrated in FIGS. 16 and 17, the retaining apparatus 16 passes endwise through the bore 50 defined in the nose portion 26 of the adapter 12 and extends, at least partially, endwise into each of the holes or openings 90, 92 defined by tooth 14 thereby securing the adapter 12 and tooth 14 in operable combination relative to each other. The retaining apparatus 16 illustrated in FIGS. 16 and 17 includes an elongated, hollow rigid sleeve 95 accommodated within bore 50 of the nose portion 26 of the adapter 12 and an elongated pin 96 snuggly yet slidably fitted within and extending axially beyond opposite ends of the sleeve 94 for engaging the aligned holes or opening 90, 92 in the tooth 14 thereby releasably interconnecting and maintaining the adapter 12 and tooth 14 in operable combination relative to each other.

Figure 18:
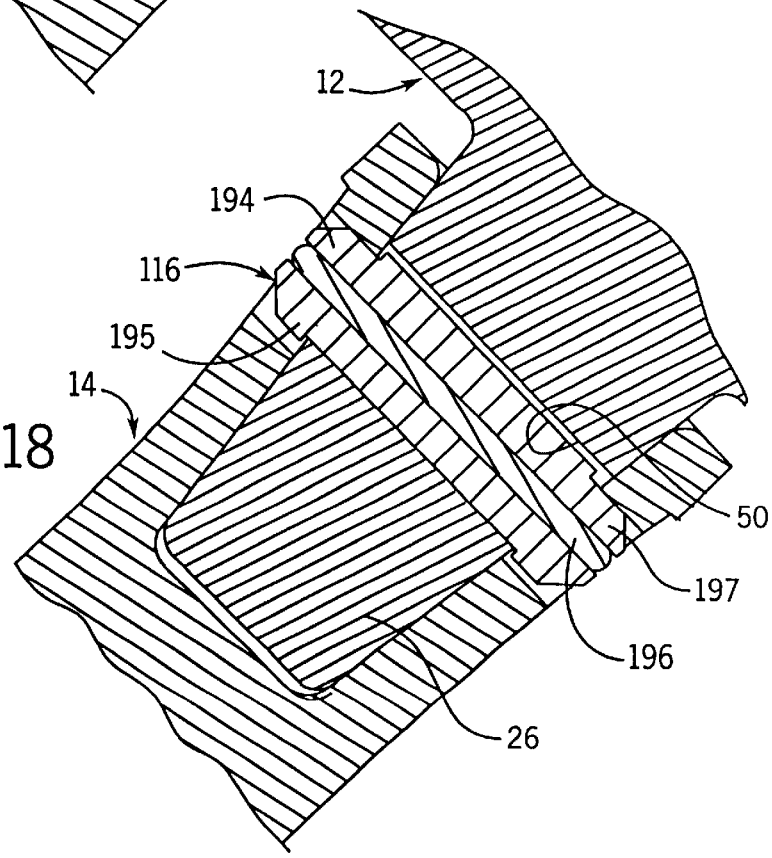
FIG. 18 is a view similar to FIG. 17 but showing an alternative cross-sectional configuration for a retainer pin assembly for releasably holding the adapter and digging or excavating tooth in operable combination relative to each other.

Another embodiment of a retaining apparatus for holding and maintaining the adapter 12 and tooth in operable combination relative to each other is illustrated in FIG. 18. This alternative form of retaining apparatus is designated generally by reference numeral 116. The elements of this alternative form of retaining apparatus that are identical or functionally analogous to those components of the retainer pin structure or fastener 16 discussed above are designated by reference numerals identical to those used above with the exception that this embodiment of the retaining apparatus uses reference numerals in the one-hundred series.

In this form, the retaining apparatus 116 is of a conventional design and includes an elongated pin assembly 194 passing through and extending axially beyond the bore 50 in the nose portion 26 of the adapter 12. As is known in the art, the pin assembly 194 typically includes a pair of pin halves 195 and 197 that are bonded and otherwise sandwich a resilient elastomeric member 196 therebetween. The pin halves 195 and 197 are appropriately configured along their lengths thereof to normally maintain the pin assembly 194 against endwise displacement during an excavating operation.

Figure 19:
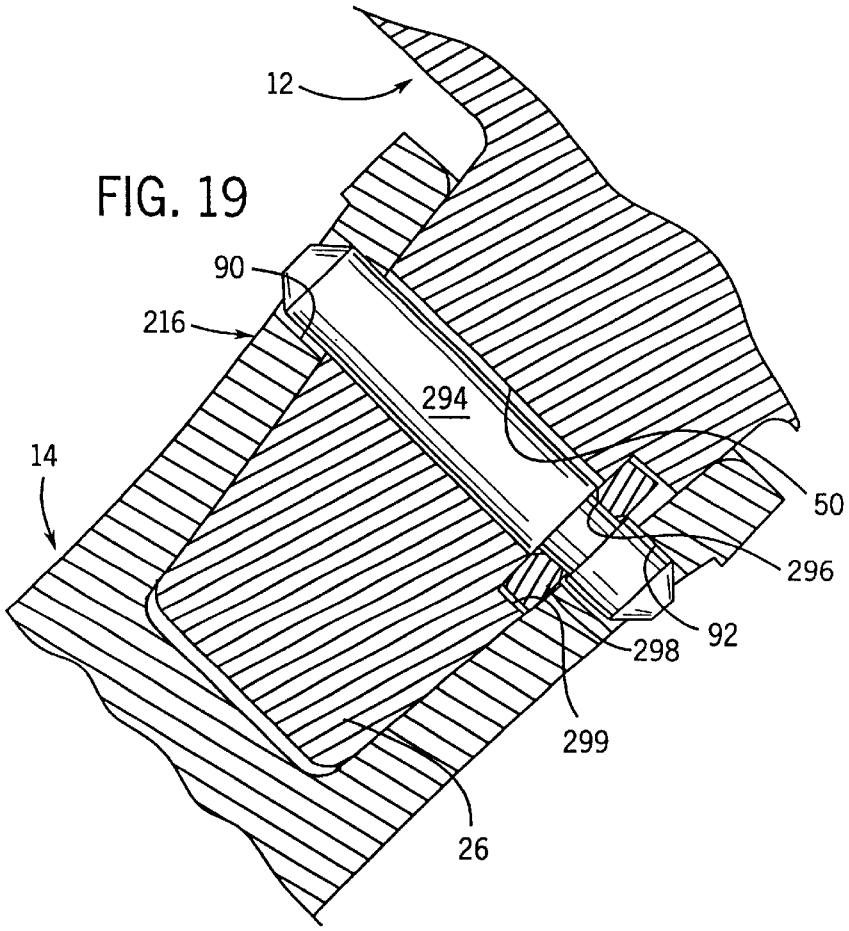
FIG. 19 is a view similar to FIG. 17 but illustrating in cross section another alternative configuration of a retainer pin assembly for releasably holding the excavating tooth and adapter in releasable but operable combination relative to each other.

Still another embodiment of a retaining apparatus for holding and maintaining the adapter 12 and tooth in operable combination relative to each other is illustrated in FIG. 19. This alternative form of retaining apparatus is designated generally by reference numeral 216. The elements of this alternative form of retaining apparatus that are identical or functionally analogous to those components of the retaining apparatus 16 discussed above are designated by reference numerals identical to those used above with the exception that this embodiment of the retaining apparatus 216 uses reference numerals in the two-hundred series.

In this form, the retaining apparatus 216 is of a conventional design and includes an elongated pin 294 passing through and an endwise extending beyond the bore 50 and adjacent the rear end of defined in the nose portion 26 of the adapter 12. As described above, the bore or recess 50 extends along an axis intersecting opposite sides on the top and bottom angles surfaces of the nose portion of the adapter 12. Notably, the opposite free ends of pin 294 pass at least partially through and engage the perimeter of the axially aligned holes or openings 90, 92 defined by tooth 14. In this form, the retaining apparatus 216 further includes a resilient snap ring 298 preferably carried within a suitably shaped recess or counterbone 299 defined by the bottom surface of the nose portion 26 of the adapter 12 preferably toward the lower end of and in generally concentric relationship relative to the bore 50. In this embodiment, an outer peripheral margin of the counterbore 299 is wholly surrounded by the angled side on the bottom surface of the nose portion intersected by the axis defined by bore 50 to add strength and rigidity to a weakened area of the adapter. As will be appreciated by those skilled in the art, as the elongated pin 294 is forced therethrough, the ring 298 will radially expand when the pin 294 is axially forced therethrough. After a lenghtwise portion of the retainer pin 294 extends through the ring 298, an annular groove 296 on the pin 294 again permits contraction of the ring 298 about the pin and into the groove 296 thereby normally inhibiting the pin 294 from endwise movement relative to the adapter 12 and tooth 14.

Yet another alternative form of retaining apparatus for releasably holding and maintaining the adapter and tooth of the multi-piece tooth assembly in operable combination relative to each other is illustrated in FIG. 20. This alternative form of retaining apparatus is designated generally by reference numeral 316. The elements of this alternative form of retaining apparatus that are identical or functionally analogous to those components of the retaining apparatus 16 discussed above are designated by reference numerals identical to those used above with the exception that this embodiment of the retaining apparatus uses reference numerals in the three-hundred series.

Figure 21:
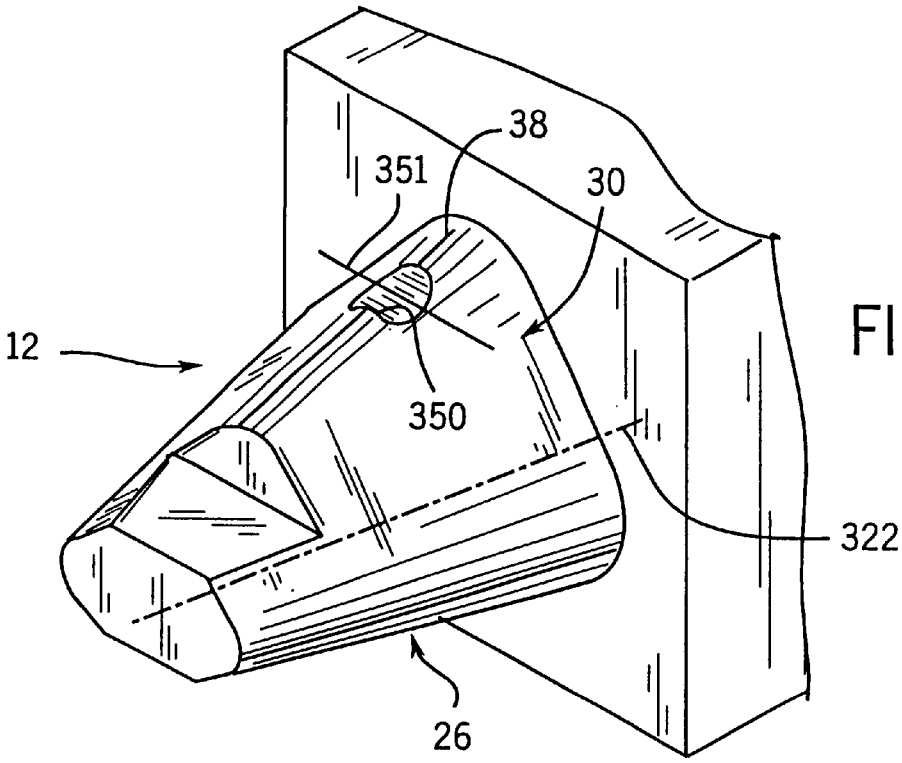
FIG. 21 is a view similar to FIG. 7 showing a perspective view of a nose portion of the adapter illustrated in FIG. 20 and capable of accommodating the alternative pin retaining structure illustrated in FIG. 20.

In this form, the retaining apparatus 316 is of conventional design and includes an elongated pin 394 passing transversely across and in operable engagement with a raised ridge or top edge 38 on the top surface 30 of the nose portion 26 of adapter 12. In this form, the excavating tooth 14 is provided with a pair of axially aligned holes or opening 390 and 392 disposed on opposite sides of the upper surface 60 thereof Moreover, in this form, and as shown in FIG. 21, the top edge 38 on the nose portion 26 of the adapter 12 is provided with a transversely extending open top channel or recess 350. Notably, the recess or channel 350 defines an axis 351 extending transversely across and generally normal to the longitudinal axis 322 of the adapter 12. As shown, opposite ends of the channel 350 open to opposite sides 36, 37 of the top surface 30 and on opposite lateral sides of the centerline of the adapter. As will be appreciated, channel 350 is axially positioned along the length of the nose portion 26 of the adapter 12 so as to coact with the axially aligned openings 390, 392 (FIG. 20) on the tooth 14 in holding the tooth and the adapter in releasable combination relative to each other after the retaining apparatus 316 is inserted through each.

As will be appreciated, both the axially aligned holes 390, 392 on the tooth 14 and the channel 350 on the adapter 12 are sized to snuggly accommodate the pin 394 of retaining apparatus 316. In a manner known in the art, the fastener pin 394 preferably has an elongated split configuration with a natural resilient bias tending to force the pin 394 to naturally expand radially outwardly while allowing for radial contraction of the pin 394 to allow it to slidably fit through the holes 390, 392 and channel 350. After the tooth is assembled to the adapter, the holes 390, 392 align with the channel 350 thereby allowing the retainer pin 394 to pass endwise therethrough. As will be appreciated, after the pin 394 is passed therethrough, a lengthwise portion of the pin 394 engages the channel 350 thereby inhibiting endwise movement of the tooth relative to the adapter. In this embodiment, the channel 350 extends only through a limited area of the adapter 12 thereby adding strength to the nose portion 26 of the adapter 12.

Figure 22:
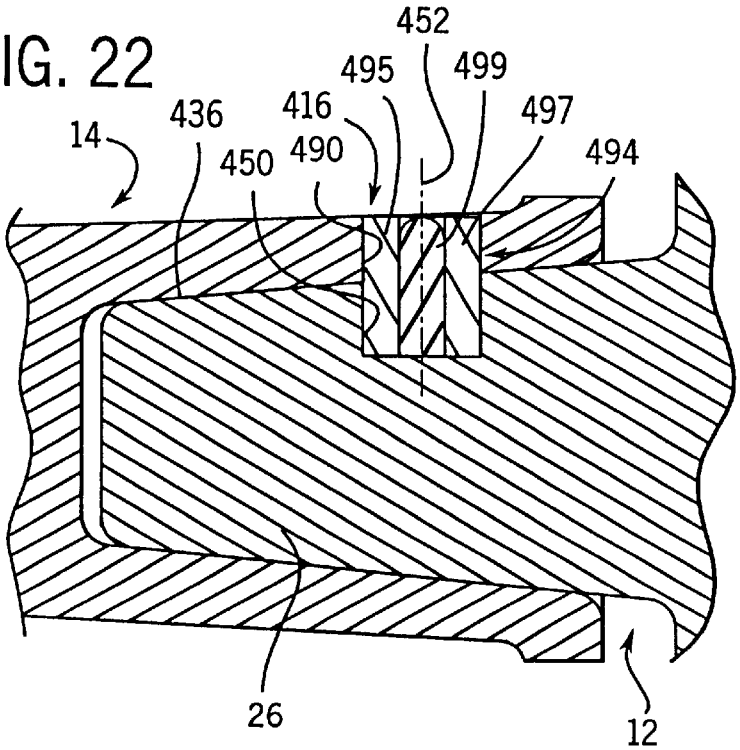
FIG. 22 is a longitudinal sectional view of an adapter having an alternative form of retainer pin structure for releasably fastening a nose portion of an adapter and a digging tooth fitted in operable combination relative to each other.

Another alternative form of retaining apparatus for releasably holding and maintaining the adapter and tooth of the multi-piece tooth assembly in operable combination relative to each other is illustrated in FIG. 22. This alternative form of retaining apparatus is designated generally by reference numeral 416. The elements of this alternative form of retaining apparatus that are identical or functionally analogous to those components of the retaining apparatus 16 discussed above are designated by reference numerals identical to those used above with the exception that this embodiment of the fastener 416 uses reference numerals in the four-hundred series.

In this form, the retainer pin structure 416 includes a stub fastener 494 passing through an opening 490 defined on one side of the digging or excavating tooth 14 and accommodated within a blind recess or opening 450 defined on a side 436 of the top surface 430 of the adapter 12. The stub fastener 494 includes a pair of halves 495 and 497 resiliently joined to each other by an elastomeric member 499 which is bonded to confronting surfaces on the pin halves 495 and 497. In a preferred form, the pin halves 495 and 497 are disposed in a fore-and-aft relationship relative to each other such that when the multi-piece excavating tooth assembly is assembled the retaining apparatus 416 serves to bias the tooth 14 lengthwise onto the nose portion 26 of the adapter 12.

Figure 23:
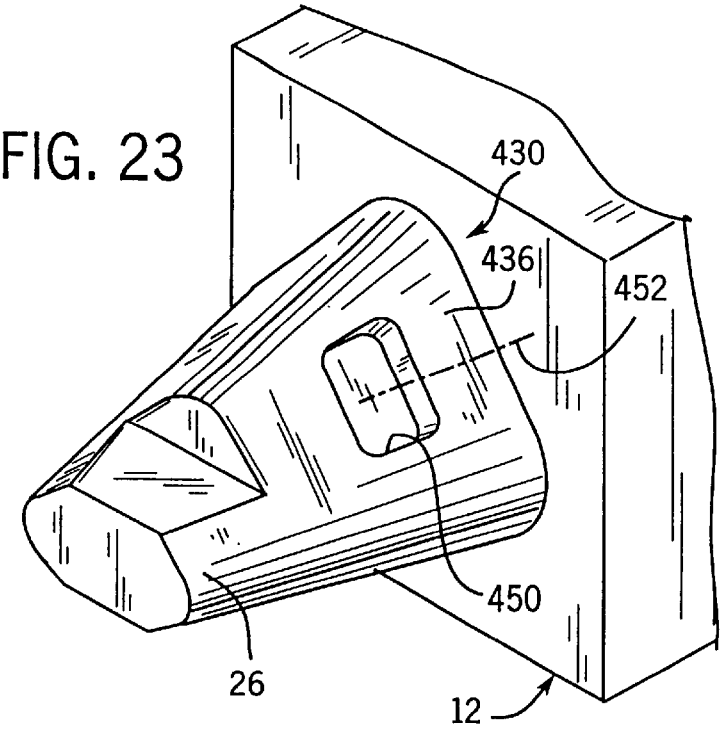
FIG. 23 is a view similar to FIG. 21 showing a perspective view of a nose portion of the adapter illustrated in FIG. 22 and capable of accommodating the alternative form of retaining pin structure.

As shown in FIG. 23, the blind recess 450 is configured to accommodate the free end of the stub fastener 494. As illustrated, the blind recess or opening 450 opens to the side 436 of the top surface 430 of the adapter 12 and is disposed along an axis 452 extending generally normal to the generally planar side 436 of the top surface 430 of the adapter 12. As will be appreciated, the recess 450 is axially disposed in predetermined relation relative to the opening 490 in the tooth 12 after the components of the multi-piece tooth assembly are connected to each other. After the retaining apparatus 416 passes through the opening 490 in the tooth 12, a lengthwise portion of the retaining apparatus 416 is accommodated within the recess 450 thereby inhibiting endwise movement of the tooth 12 and adapter 14 relative to each other. Moreover, and because with this embodiment, the recess 450 extends only partially through a limited area of the adapter 12, the nose portion 26 of the adapter 12 is provided with extra strength and rigidity.

Still another alternative form of retaining apparatus for releasably holding and maintaining the adapter and tooth of the multi-piece tooth assembly in operable combination relative to each other is illustrated in FIG. 24. This alternative form of retaining apparatus is designated generally by reference numeral 516. The elements of this alternative form of retaining apparatus that are identical or functionally analogous to those components of the retaining apparatus 16 discussed above are designated by reference numerals identical to those used above with the exception that this embodiment of the retaining apparatus uses reference numerals in the five-hundred series.

In this form, the retaining apparatus 516 is substantially similar to that disclosed in U.S. Pat. No. 4,611,418 granted on Sep. 16, 1986; the full disclosure of which is incorporated herein by reference. Suffice it to say, and as shown in FIGS. 24 and 25, the retaining apparatus 516 includes a resiliently biased detent 594. As illustrated in FIG. 24, the detent 594 is accommodated within a recess or opening 550 defined on the nose portion 26 of the adapter 12. A recess or opening 590 is cooperatively arranged on the digging tooth 12 for accommodating the free end of the detent 594. As shown, the hole or recess 550 for accommodating the retaining apparatus 516 defines an axis 552 disposed generally normal to the planar configuration of a side on one of either the top or bottom surfaces of the nose portion 26 of the adapter.

As shown in FIG. 24, a plurality of detents can be arranged in cooperative relationship relative to each other. When a plurality of detents 594, similar to that disclosed in FIGS. 24 and 25, are arranged in cooperative relationship relative to each other to releasably fasten the tooth and adapter in operable combination relative to each other, the axial disposition of the detents 594 may require axial spacing along the length of the nose portion 26 of the adapter 12. As will be appreciated by those skilled in the art, a curved surface at the leading edge of the blind cavity 68 defined by the tooth 14 will facilitate compression of the resilient fastener 594 during assembly of the tooth and adapter.

FIG. 26 illustrates another form for the adapter 12. This alternative form of adapter is designated generally by reference numeral 612. The elements of this alternative form of the adapter that are identical or functionally analogous to those components discussed above regarding adapter 12 are designated by reference numerals identical to those used above with the exception that this embodiment used reference numerals in the six-hundred series.

In this embodiment of the invention, the adapter 612 includes a base portion 624 and a nose portion 626 in axially aligned relationship relative to each other and defines a centerline 622. Like adapter 12, adapter 612 is preferably fabricated from a forging operation to extend the durability and, thus, life of the adapter 612. As discussed above, the nose portion 626 of adapter 612 has an axially elongated tapered configuration with top and bottom surfaces 630 and 640, respectively, sloping or slanting and converging toward a free end of the nose portion 626. As shown, the top and bottom surfaces 630 and 640, respectively, are disposed above and below, respectively, the longitudinal centerline 622.

The top surface 630 includes two sides or facets 636 and 637 extending forwardly from the base portion 624 of the adapter 612 and disposed on opposite lateral sides of the longitudinal centerline 622 and which intersect or merge with each other along a common top edge 638. The common top edge 638 extends for a major length of the nose portion 626 of the adapter 612 and is generally centralized along the longitudinal centerline 622 thereof.

In this embodiment of the invention, each side or facet 636, 637 forming the top surface 630 of the adapter 612 has a generally planar configuration. Moreover, in this form of the invention, the sides 636, 637 forming the top surface 630 of the adapter 612 are each slanted at an angle of about 35° relative to a horizontal plane.

In the embodiment of the adapter illustrated in FIG. 26, the bottom surface 640 of the adapter 612 has a complementary configuration relative to the top surface 630. That is, the lower or bottom surface 640 of the nose portion 626 of adapter 612 has two sides 646, 647 joined or which are merged relative to each other by a common bottom edge 648 and are disposed on opposite lateral sides of the longitudinal centerline 622 of the adapter 612. The two lower or bottom sides 646, 647 likewise extend forwardly from the base portion 624 of the adapter 612 toward the free end thereof The common edge 648 joining or merging the two sides 646, 647 forming the bottom surface 640 extends for a major length of the nose portion 626 of the adapter and is disposed generally centrally relative to the longitudinal centerline 622.

In this embodiment, the two sides 646, 647 forming the bottom or lower surface 640 of the adapter 612 each have a generally planar configuration. Moreover, in this embodiment, the sides 646, 647 forming the lower or bottom surface 640 of the nose portion of the adapter 612 are each slanted at an angle of about 35° relative to a horizontal plane.

In the embodiment of illustrated in FIG. 26, the angularly disposed sides 636 and 646 partially forming the top and bottom surfaces 630 and 640, respectively, and which are disposed to one side of the longitudinal centerline 622 of the adapter 612, are likewise joined to each other along a common side edge 639 extending longitudinally forward from the base portion 624 of the adapter 612. Similarly, with the embodiment illustrated in FIG. 26, the angularly disposed sides 637 and 647 partially forming the top and bottom surfaces 630 and 640, respectively, and which are arranged on an opposite side of the longitudinal axis 622 of the adapter 612 are joined to each other along a common side edge 649 extending longitudinally forward from the base portion 624 of the adapter 612.

The generally planar configurations of the sides 636, 637 and 646, 647 of the top and bottom surfaces 630 and 640, respectively, provides the nose portion 626 of the adapter 612 with a generally rectangular cross-sectional configuration having an increasing cross-sectional area as measured from a forward end thereof. Suffice it to say, in the embodiment illustrated in FIG. 26, a major lengthwise section of the nose portion 626 of the adapter 612 is angularly offset or canted relative to the base portion 624 of the adapter 612.

The nose portion 626 of the adapter 612 likewise defines a bore 650 or opening extending through the adapter 612 and open at opposite ends thereof for accommodating a suitable fastener (not shown) used to hold and maintain the adapter 612 and tooth 614 in operable combination relative to each other. As illustrated in FIG. 26, the bore 650 defines an axis 652 which can be disposed generally normal to at least one of the sides 636, 637 or 646, 647 of the top and bottom surfaces, respectively, to facilitate fabrication of the bore 650. Notably, the bore 650 opens at opposite ends to diametrically opposed sides 636, 647 of the top and bottom surfaces 630, 640, respectively, of the nose portion 626 of adapter 612.

FIG. 27 illustrates still another form for the adapter 12. This alternative form of adapter is designated generally by reference numeral 712. The elements of this alternative form of the adapter that are identical or functionally analogous to those components discussed above regarding adapter 12 are designated by reference numerals identical to those used above with the exception that this embodiment used reference numerals in the seven-hundred series.

In this embodiment, the adapter 712 includes a base portion 724 and a nose portion 726 in axially aligned relationship relative to each other and defines a centerline 722. Like adapter 12, adapter 712 is preferably fabricated from a forging operation to extend the durability and, thus, expected life of the adapter 712. As discussed above, the nose portion 726 of adapter 712 has an elongated tapered configuration with top and bottom surfaces 730 and 740, respectively, sloping or slanting and converging toward a free end of the nose portion 726. As shown, the top and bottom edges 730 and 740, respectively, are disposed above and below, respectively, the longitudinal centerline 722.

The top surface 730 includes two sides 736 and 737 extending forwardly from the base portion 724 of the adapter 712 and disposed on opposite lateral sides of the longitudinal centerline 722 and which intersect or merge with each other along a common top edge 738. The common top edge 738 extends for a major length of the nose portion 726 of the adapter 712 and is generally centralized along the longitudinal centerline 722 thereof.

In this embodiment, each side 736, 737 forming the top surface 730 of the adapter 712 has a generally planar configuration. Moreover, in this form, the sides 736, 737 forming the top surface 730 of the adapter 712 are each slanted at an angle of about 45° relative to a horizontal plane.

In the embodiment of the adapter illustrated in FIG. 27, the bottom surface 740 of the adapter 712 has a configuration similar relative to the top surface 730. That is, the lower or bottom surface 740 of the nose portion 726 of adapter 712 has two sides 746, 747 joined or which are merged relative to each other by a common bottom edge 748 and are disposed on opposite lateral sides of the longitudinal centerline 722 of the adapter 712. The two lower or bottom sides 746, 747 likewise beyond forwardly from the base portion 724 of the adapter 712 toward the free end thereof. The common edge 748 joining or merging the two sides 746, 747 forming the bottom surface 740 extends for a major length of the nose portion 726 of the adapter 712 and is disposed generally centrally relative to the longitudinal centerline 722.

In this illustrated embodiment, each side 746, 747 forming the bottom or lower surface 740 of the adapter 712 has a generally planar configuration. Notably, however, with this embodiment, the sides 746, 747 forming the lower or bottom surface 740 of the nose portion 726 of the adapter 712 are angularly disposed at an angle relative to a horizontal plane different from the slanted disposition of the sides 736, 737 forming the top surface 730 of the nose portion 726 of the adapter 712. In the embodiment illustrated in FIG. 27, the sides 746, 747 of the bottom surface 740 of the nose portion 726 of the adapter 712 are each slanted at an angle of about 35° relative to a horizontal plane. As will be appreciated by those skilled in the art, the angular disposition of the sides 736, 737 and 746, 747 forming the top and bottom surfaces 730, 740, respectively, of the nose portion 726 of the adapter 712 can be reversed if so desired. That is, the sides 736, 737 of the top surface 730 can be disposed at an angle of about 35° relative to a horizontal plane while the sides 746, 747 of the bottom surface 740 of the nose portion 726 of the adapter 712 can be angularly offset an at angle of 45° or greater relative to a horizontal plane without detracting or departing from the spirit and scope of the present invention.

In this embodiment, the angularly disposed sides 736 and 746 partially forming the top and bottom surfaces 730 and 740, respectively, and which are disposed to one side of the longitudinal centerline 722 of the adapter 712, are likewise joined to each other along a common side edge 739 extending longitudinally forward from the base portion 724 of the adapter 712. Similarly, with the embodiment illustrated in FIG. 27, the angularly disposed sides 737 and 747 partially forming the top and bottom surfaces 730 and 740, respectively, and which are arranged on an opposite side of the longitudinal axis 722 of the adapter 712 are joined to each other along a common side edge 749 extending longitudinally forward from the base portion 724 of the adapter 712.

The generally planar configurations of the sides 736, 737 and 746, 747 of the top and bottom surfaces 730 and 740, respectively, provides the nose portion 726 of the adapter 712 with a generally rectangular cross-sectional configuration having an increasing cross-sectional area as measured from a forward end thereof. Suffice it to say, in the embodiment illustrated in FIG. 27, a major lengthwise section of the nose portion 726 of the adapter 712 is angularly offset or canted relative to the base portion 724 of the adapter 712.

The nose portion 726 of the adapter 712 likewise defines a bore 750 or opening extending through the adapter 712 and open at opposite ends thereof for accommodating the fastener (not shown) for interconnecting the adapter 712 to a suitably shaped digging or excavating tooth. As illustrated in FIG. 27, the bore 750 defines an axis 752 which is disposed generally normal to at least one of the sides 736, 737 or 746, 747 of the top and bottom surfaces, respectively, to facilitate fabrication of the bore 750. Notably, the bore 750 opens at opposite ends to diametrically opposed sides 736, 747 of the top and bottom surfaces 730, 740, respectively, of the nose portion 726 of the adapter 712.

FIG. 28 illustrates still another embodiment of an adapter. This alternative form of adapter is designated generally by reference numeral 812. The embodiment illustrated in FIG. 28 is substantially similar to that illustrated and described above with respect to FIG. 26 except the angular disposition of the sides forming the top and bottom surfaces of the nose portion of the adapter are each offset and an angle ranging between about 55° to about 65° relative to a horizontal plane.

Yet another embodiment of an adapter is illustrated in FIG. 29. This alternative form of adapter is designated generally by reference numeral 912. The elements of this alternative form of the adapter that are identical or functionally analogous to those components discussed above regarding adapter 12 are designated by reference numerals identical to those used above with the exception that this embodiment used reference numerals in the nine-hundred series.

In this embodiment, the adapter 912 includes a base portion 924 and a nose portion 926 in axially aligned relationship relative to each other and defines a centerline 922. Like adapter 12, adapter 912 is preferably fabricated from a forging operation to extend the durability and, thus, life of the adapter 912. The nose portion 926 of adapter 912 has an elongated tapered configuration with top and bottom surfaces 930 and 940, respectively, sloping or slanting and converging toward the free end of the nose portion 926. As shown, the top and bottom surfaces 930 and 940, respectively, are disposed above and below, respectively, the longitudinal centerline 922.

The top surface 930 includes two sides 936 and 937 extending forwardly from the base portion 924 of the adapter 912 and disposed on opposite lateral sides of the longitudinal centerline 922 and which intersect or merge with each other along a common top edge 938. The common top edge 938 extends for a major length of the nose portion 926 of the adapter 912 and is generally centralized along the longitudinal centerline 922 thereof.

In this embodiment, each side 936, 937 forming the top surface 930 of the adapter 912 has a generally planar configuration. Moreover, in this form, the sides 936, 937 forming the top surface 930 of the adapter 912 are each slanted at an angle of about 25° relative to a horizontal plane.

In the embodiment of the adapter illustrated in FIG. 29, the bottom surface 940 of the adapter 912 has two sides 946, 947 joined or which are merged relative to each other by a common bottom edge 948 and are disposed on opposite lateral sides of the longitudinal centerline 922 of the adapter 912. The two lower or bottom sides 946, 947 likewise extend forwardly from the base portion 924 of the adapter 912 toward the free end thereof The common edge 948 joining or merging the two sides 946, 947 forming the bottom surface 940 extends for a major length of the nose portion 926 of the adapter 912 and is disposed generally centrally relative to the longitudinal centerline 922.

In this illustrated form, each side 946, 947 forming the bottom or lower surface 940 of the adapter 912 has a generally planar configuration. Moreover, with this form, the sides 946, 947 forming the lower or bottom surface 940 of the nose portion of the adapter 912 are each slanted at an angle of about 45° relative to a horizontal plane.

In this embodiment, the angularly disposed sides 936 and 946 partially forming the top and bottom surfaces 930 and 940, respectively, and which are disposed to one side of the longitudinal centerline 922 of the adapter 912, are likewise joined to each other along a generally vertical side surface 939 extending longitudinally forward from the base portion 924 of the adapter 912. Similarly, with the embodiment illustrated in FIG. 29, the angularly disposed sides 937 and 947 of the top and bottom surfaces 930 and 940, respectively, and which are arranged on an opposite side of the longitudinal axis 922 of the adapter 912, are joined to each other along a generally vertical side surface 949 extending longitudinally forward from the base portion 924 of the adapter 912.

The nose portion 926 of the adapter 912 likewise defines a bore or opening 950 extending through the adapter 912 and open at opposite ends thereof for accommodating a suitable fastener (not shown) used to hold used to hold and maintain the adapter 912 and excavating or digging tooth in operable combination relative to each other. As illustrated in FIG. 29, the bore 950 defines an axis 952 which is disposed generally normal to at least one of the sides 936, 937 or 946, 947 of the top and bottom surfaces 930 or 940, respectively, to facilitate fabrication of the bore 950.

Yet another embodiment of an adapter is illustrated in FIG. 30. This alternative form of adapter is particularly useful on loader machine applications and is designated generally by reference numeral 1012. The elements of this alternative form of the adapter that are identical or functionally analogous to those components discussed above regarding adapter 12 are designated by reference numerals identical to those used above with the exception that this embodiment used reference numerals in the one thousand series.

In this embodiment, the adapter 1012 includes a base portion 1024 and a nose portion 1026 in axially aligned relationship relative to each other and defines a centerline 1022. The nose portion 1026 of adapter 1012 has an elongated tapered configuration with top and bottom surfaces 1030 and 1040, respectively, sloping or slanting and converging toward the free end of the nose portion 1026. As shown, the top and bottom surfaces 1030 and 1040, respectively, are disposed above and below, respectively, the longitudinal centerline 1022.

The top surface 1030 includes two sides or facets 1036 and 1037 extending forwardly from the base portion 1024 of the adapter 1012 and disposed on opposite lateral sides of the longitudinal centerline 1022 and which intersect or merge with each other along a common top edge 1038. The common top edge 1038 extends for a major length of the nose portion 1026 of the adapter 1012 and is generally centralized along the longitudinal centerline 1022 thereof In this embodiment, each side or facet 1036, 1037 forming the top surface 1030 of the adapter 1012 has a generally planar configuration. Moreover, the sides 1036, 1037 forming the top surface 1030 of the adapter 1012 are each slanted at an angle ranging between about 35° and about 55° relative to a horizontal plane.

In the embodiment of the adapter illustrated in FIG. 30, the bottom surface 1040 of the adapter 1012 has two sides 1046, 1047 joined or which are merged relative to each other by a common bottom edge 1048 and are disposed on opposite lateral sides of the longitudinal centerline 1022 of the adapter 1012. The two lower or bottom sides 1046, 1047 likewise extend forwardly from the base portion 1024 of the adapter 1012 toward the free end thereof. The common edge 1048 joining or merging the two sides 1046, 1047 forming the bottom surface 1040 extends for a major length of the nose portion 1026 of the adapter 1012 and is disposed generally centrally relative to the longitudinal centerline 1022.

In this illustrated form, each side or facet 1046, 1047 forming the bottom or lower surface 1040 of the adapter 1012 has a generally planar configuration. Moreover, with this form, the sides 1046, 1047 forming the lower or bottom surface 1040 of the nose portion of the adapter 1012 are each downwardly slanted to form an included angle of about 5° to 15° with a horizontal plane.

In this embodiment, the angularly disposed sides 1036 and 1046 partially forming the top and bottom surfaces 1030 and 1040, respectively, and which are disposed to one side of the longitudinal centerline 1022 of the adapter 1012, are likewise joined to each other along a common side edge 1039 extending longitudinally forward from the base portion 1024 of the adapter 1012. Similarly, with the embodiment illustrated in FIG. 30, the angularly disposed sides 1037 and 1047 of the top and bottom surfaces 1030 and 1040, respectively, and which are arranged on an opposite side of the longitudinal axis 1022 of the adapter 1012, are joined to each other along a common side edge 1049 extending longitudinally forward from the base portion 1024 of the adapter 1012.

The nose portion 1026 of the adapter 1012 likewise defines a bore or opening 1050 extending through the adapter 1012 and open at opposite ends thereof for accommodating a suitable retaining apparatus (not shown) used to hold used to hold and maintain the adapter 1012 and excavating or digging tooth in operable combination relative to each other. As illustrated in FIG. 30, the bore 1050 defines an axis 1052 which is disposed generally normal to at least one of the sides or facets 1036, 1037 of the top surface 1030 to facilitate fabrication of the bore 1050.

Yet another embodiment of an adapter is illustrated in FIG. 31. This alternative form of adapter is particularly useful on loader machine applications and is designated generally by reference numeral 1112. The elements of this alternative form of the adapter that are identical or functionally analogous to those components discussed above regarding adapter 12 are designated by reference numerals identical to those used above with the exception that this embodiment uses reference numerals in the one thousand-one hundred series.

In this embodiment, the adapter 1112 includes a base portion 1124 and a nose portion 1126 in axially aligned relationship relative to each other and defines a centerline 1122. The nose portion 1126 of adapter 112 has an elongated tapered configuration with top and bottom surfaces 1130 and 1140, respectively, sloping or slanting and converging toward the free end of the nose portion 1126. As shown, the top and bottom surfaces 1130 and 1140, respectively, are disposed above and below, respectively, the longitudinal centerline 1122.

The top surface 1130 includes two sides or facets 1136 and 1137 extending forwardly from the base portion 1124 of the adapter 1112 and disposed on opposite lateral sides of the longitudinal centerline 1122 and which intersect or merge with each other along a common top edge 1138. The common top edge 1138 extends for a major length of the nose portion 1126 of the adapter 1112 and is generally centralized along the longitudinal centerline 1122 thereof.

In this embodiment, each side or facet 1136, 1137 forming the top surface 1130 of the adapter 1112 has a generally planar configuration. Moreover, the sides 1136, 1137formingthetop surface 1130 oftheadapter 1112 are each slanted at an angle ranging between about 35° and about 55° relative to a horizontal plane.

In the embodiment of the adapter illustrated in FIG. 31, the bottom surface 1140 of the adapter 1112 has a generally flat side or facet 1146 extending thereacross so as to be disposed on opposite lateral sides of and extending generally normal to the longitudinal centerline 1122 of the adapter 1112 and generally parallel to a horizontal plane. The lower side 1146 extends forwardly from the base portion 1124 of the adapter 1112 toward the free end thereof In this embodiment, the angularly disposed side 1136 partially forming the top surface 1130 is joined to the bottom surface 1140 along a common side edge 1139 extending longitudinally forward from the base portion 1124 of the adapter 1112. Similarly, with the embodiment illustrated in FIG. 31, the angularly disposed side 1137 partially forming the top surface 1130 is joined to the bottom surface 1140 along a common side edge 1149 extending longitudinally forward from the base portion 1024 of the adapter 1012.

The nose portion 1126 of the adapter 112 likewise defines a bore or opening 1150 extending through the adapter 1112 and open at opposite ends thereof for accommodating a suitable retaining apparatus (not shown) used to hold used to hold and maintain the adapter 1112 and excavating or digging tooth in operable combination relative to each other. As illustrated in FIG. 31, the bore 1150 defines an axis 1152 which is disposed generally normal to at least one of the sides or facets 1136, 1137 of the top surface 1130 to facilitate fabrication of the bore 1150.

Although not specifically illustrated, it should be appreciated by those skilled in the art the opposed sides of either the top or bottom surfaces of the adapter do not necessarily need to be disposed at the same angle relative to each other or relative to a generally horizontal plane. That is, there can be some angular variation between opposed sides of either the top or bottom surfaces on the adapter without detracting or departing from the spirit and scope of the present invention.

As will be appreciated by those skilled in the art, and to enhance the conjuncture between the tooth and adapter, the cross-sectional configurations of the nose portion of the adapter and the blind cavity defined by the tooth will generally correspond relative to each other. Accordingly, if the nose portion of the adapter has a cross-sectional configuration similar to that illustrated in FIG. 26, the blind cavitv defined at the rear end of the tooth will have a similar cross-sectional configuration thereby enhancing the conjuncture therebetween. Similarly, if the nose portion of the adapter has a cross-sectional configuration similar to that illustrated in FIG. 29, the blind cavity opening to the rear end of the tooth will have a corresponding cross-sectional configuration.

The cross-sectional configurations for the blind cavity of the digging tooth and the nose portion of the adapter disclosed above offers several distinct features heretofore unknown in prior art devices. First, the cross sectional size or area of the nose portion of the adapter can be fabricated from the same amount of material as heretofore known comparable adapters while offering enhanced strength and rigidity. Thus, and while neither increasing the material nor weight of the adapter, the strength and rigidity thereof is significantly increased. By canting the cross sectional configuration of the nose portion of the adapter relative to the base portion, a significant increase in material thickness is provided in both the vertical and horizontal directions, thus, permitting the adapter to withstand significantly higher forces. As will be appreciated, the angular orientation of the sides forming the top and bottom surfaces of the adapter can be shaped during fabrication for different digging operations and yet offer enhanced strength and durability beyond cross sectional configurations disposed in the conjuncture of a conventionally configured multipiece tooth assembly. Thus, the cross-sectional design of the conjuncture between the tooth and adapter of the multi-piece tooth assembly can be specifically configured to coincide with expectant vertical or horizontal increases associated with the earth engaging tool.

Second, the angular orientation of the those components of the digging tooth and adapter forming the conjuncture therebetween allows for self-centering of a relatively loose fitted tooth on the adapter. Moreover, the tooth and adapter components of the multipiece tooth assembly have been significantly modified from previous multipiece digging tooth designs to purposefully distinguish the component parts of the present invention from the prior art. That is, the canted or angled configuration of the nose portion of the adapter relative to the base or mounting portion, while offering those operational benefits described above, furthermore serves to distinguish the adapter of the present invention from all other heretofore known designs. Similarly, the angled or canted configuration of the blind cavity or pocket at the rear end portion of the digging tooth distinguishes the excavating tooth of from all others.

Moreover, and as will be appreciated by those skilled in the art, the angled orientation of the retaining apparatus accomplished with the present invention offers enhanced advantages over either vertical or horizontally disposed retaining pin systems. As will be appreciated, arranging the axis of the bore for accommodating and holding the retaining pin at an angle generally normal to opposed sides of the angled top and bottom surfaces of the adapter facilitates fabrication of the adapter. Also, the angular orientation of the retaining apparatus allows for superior access thereto to effect repair and/or replacement of the digging tooth. Furthermore, the materials being excavated and the vertical and horizontal movements of the excavating tooth assembly, as well as the forces resulting therefrom, have significantly lesser effect on the angularly disposed retaining apparatus of the present invention as compared with heretofore known retaining pin systems. Additionally, the slanted or canted orientation of the retaining apparatus offers ergonomic advantages during repair or replacement of the digging tooth. Such ergonomic advantages are more fully realized with the bucket or loading implement in a lower vertical disposition. Moreover, the slanted orientation of the retaining apparatus facilitates assembly and proper orientation of the digging or excavating tooth relative to the adapter thereby allowing the user to take full advantage of the design characteristics associated with such digging teeth.

From the foregoing, it will be observed that numerous modifications and variations can be effected without departing from the true spirit and scope of the novel concept of the present invention. It will be appreciated that the present disclosure is intended to set forth exemplifications of the present invention and are not intended to limit the invention to the specific embodiments illustrated. The disclosure is intended to cover by the appended claims all such modifications and colorful variations as fall within the spirt and scope of the claims.

What is claimed is:

1. An adapter for a multipiece excavating tooth assembly, comprising:

an elongated member having a base portion and an elongated nose portion axially arranged relative to each other along a longitudinal centerline of said member, said base portion being configured to permit attachment of said adapter to excavating equipment, and wherein said elongated nose portion terminates at a free forward end and has top and bottom angled surfaces disposed generally above and below the longitudinal centerline of said member, respectively, with the top surface of said nose portion having two downwardly disposed and angled sides arranged on opposite lateral sides of the longitudinal centerline of said member, and with the bottom surface of said nose portion having two upwardly disposed and angled sides arranged on opposed sides of the longitudinal centerline of said member, and with said nose portion further defining an opening disposed adjacent a rear end of the nose portion, said opening extending along an axis intersecting opposite sides on the top and bottom angled surfaces of the nose portion of said member, and wherein the angled side on the bottom surface of said nose portion intersected by the axis of said opening defines a counterbore arranged concentric relative to said axis for accommodating a retainer ring of a retaining apparatus, and wherein an outer peripheral margin of said counterbore is wholly surrounded by said angled side on the bottom surface of said nose portion intersected by the axis of said recess to add strength and rigidity to a weakened area of the adapter.

2. The adapter according to claim 1 wherein the axis of said opening defined in the nose portion of said member extends at an angle of about 45° relative to a generally horizontal plane.

3. The adapter according to claim 1 wherein the axis of said opening defined in the nose portion of said member extends generally normal to the angled side on the bottom surface of the elongated member.

4. The adapter according to claim 1 wherein the nose portion of said member is provided with four sides, with the two angled sides on said top surface being joined to each other along a common edge extending longitudinally of said member, and with the two angled sides on the bottom surface being joined to each other along a common edge extending longitudinally of said member to provide the nose portion of said member with a cross-sectional configuration of an quadrilateral parallelogram along a major lengthwise portion thereof.

5. The adapter according to claim 4 wherein the common edge joining the two angled sides on the top surface of the elongated member has a radiused configuration.

6. The adapter according to claim 4 wherein the common edge joining the two angled sides on the bottom surface of the elongated member has a radiused configuration.

7. The adapter according to claim 1 wherein the nose portion of said member is provided with four sides, with the angled sides of said top and bottom surfaces, disposed to a respective lateral side of the longitudinal axis of said elongated member, being joined to each other along a common edge extending longitudinally of said member such that the nose portion of said member is provided with a cross-sectional configuration of a quadrilateral parallelogram along a major lengthwise portion thereof.

8. An adapter for a multipiece excavating tooth assembly, comprising:

an elongated member having a base portion and an elongated nose portion axially arranged relative to each other along a longitudinal centerline of said member, said base portion being configured to permit attachment of said adapter to excavating equipment, and wherein said elongated nose portion terminates at a free forward end and has top and bottom angled surfaces disposed generally above and below the longitudinal centerline of said member, respectively, with the top surface of said nose portion having two downwardly disposed and angled sides arranged on opposite lateral sides of the longitudinal centerline of said member, with each angled side of said top surface extending at an angle ranging between about 40° and 65° relative to a generally horizontal plane. and with the bottom surface of said nose portion having two upwardly disposed and angled sides arranged on opposed sides of the longitudinal centerline of said member, and with said nose portion further defining a recess disposed adjacent a rear end of the nose portion, said recess extending along an axis and opening to at least one angled side of said top surface of the nose portion of said member, and wherein an axis of said recess passes through the longitudinal centerline of said elongated member and extends at an angle ranging between about 40° and about 55° relative to a generally horizontal plane.

9. An adapter for a multipiece excavating tooth assembly, comprising:

an elongated member having a base portion and an elongated nose portion axially arranged relative to each other along a longitudinal centerline of said member, said base portion being configured to permit attachment of said adapter to excavating equipment, and wherein said elongated nose portion terminates at a free forward end and has top and bottom angled surfaces disposed generally above and below the longitudinal centerline of said member, respectively, with the top surface of said nose portion having two downwardly disposed and angled sides arranged on opposite lateral sides of the longitudinal centerline of said member, and wherein the two angled sides on said top surface are joined to each other along a common edge extending longitudinally of said member, and with the bottom surface of said nose portion having two upwardly disposed and angled sides arranged on opposed sides of the longitudinal centerline of said member, and wherein the two angled sides on the bottom surface are joined to each other along a common edge extending longitudinally of said member to provide the nose portion of said member with a cross-sectional configuration of an quadrilateral parallelogram along a major lengthwise portion thereof, and with said nose portion further defining a recess for accommodating at least a portion of a retaining apparatus.

10. The adapter according to claim 9 wherein the common edge joining the two angled sides on the top surface of the elongated member has a radiused configuration.

11. The adapter according to claim 9 wherein the common edge joining the two angled sides on the bottom surface of the elongated member has a radiused configuration.

12. An adapter for a multipiece excavating tooth assembly, comprising:

an elongated member having a base portion and an elongated nose portion axially arranged an elongated member having a base portion and an elongated nose portion axially arranged relative to each other along a longitudinal centerline of said member, said base portion being configured to permit attachment of said adapter to excavating equipment, and wherein said elongated nose portion terminates at a free forward end and has top and bottom angled surfaces disposed generally above and below the longitudinal centerline of said member, respectively, with the top surface of said nose portion having two downwardly disposed and angled sides arranged on opposite lateral sides of the longitudinal centerline of said member, and with the bottom surface of said nose portion having two upwardly disposed and angled sides arranged on opposed sides of the longitudinal centerline of said member, wherein the angled sides of said top and bottom surfaces, disposed to a respective side of the longitudinal axis of said elongated member, being joined to each other along a common edge extending longitudinally of said member such that the nose portion of said member is provided with a cross-sectional configuration of a quadrilateral parallelogram along a major lengthwise portion thereof, and with said nose portion further defining a recess for accommodating at least a portion of a retaining apparatus.

13. A multipiece tooth assembly for an earth engaging implement, comprising:

an adapter having a base portion and an elongated nose portion axially arranged relative to each other along a longitudinal centerline, said base portion being configured to permit attachment of said adapter to said earth engaging implement, and wherein said elongated nose portion terminates at a free forward end and has top and bottom angled surfaces disposed generally above and below said longitudinal centerline, respectively, with the top surface of said nose portion having two downwardly disposed and angled sides arranged on opposite lateral sides of said longitudinal centerline, and with the bottom surface of said nose portion having two upwardly disposed and angled sides arranged on opposed sides of said longitudinal centerline, and with said nose portion further defining an opening disposed adjacent a rear end of the nose portion and opening at opposite ends thereof, said opening extending along an axis intersecting opposite sides on the top and bottom angled surfaces of the nose portion of said member, and wherein the angled side on the bottom surface of said nose portion intersected by the axis of said opening defines a counterbore arranged concentric relative to said axis for accommodating a retainer ring of a retaining apparatus, and wherein an outer peripheral margin of said counterbore is wholly surrounded by said angled side on the bottom surface of said nose portion intersected by said the axis of said recess; and a tooth configured to fit along and about a lengthwise section of said nose portion of the adapter, said tooth defining a pair of axially aligned openings for accommodating at least a lengthwise portion of a retainer pin of said retainer pin assembly.

14. The multipiece tooth assembly according to claim 13 wherein said tooth defines a blind cavity opening to a rear end thereof, and wherein the blind cavity defined by said tooth includes top and bottom angled surfaces, with each top and bottom surface of said blind cavity including two angled sides each extending at an acute angle of about 45° relative to a ground penetrating edge of said tooth, and wherein each angled side of said top and bottom surfaces is arranged on opposite lateral sides of a longitudinal axis of said tooth.

15. The multipiece tooth assembly according to claim 14 wherein the angled sides of said top and bottom surfaces defined by said blind cavity are joined to each other along a common edge extending therebetween such that, for a majority of the length thereof, said blind cavity is provided with a cross-sectional configuration of a quadrilateral parallelogram.

16. The multipiece tooth assembly according to claim 14 wherein the cavity defined by said tooth includes four sides, with the two angled sides of said top surface being joined to each other along a common edge extending longitudinally of said cavity, and with the two angled sides of said bottom surface being joined to each other along a common edge extending longitudinally of said cavity to provide said cavity with a cross-sectional configuration of a quadrilateral parallogram along a major portion of the length thereof.

17. The multipiece tooth assembly according to claim 14 wherein the cavity defined by said tooth includes four sides, with the angled sides of said top and bottom surfaces, disposed to a respective lateral side of the longitudinal axis of said cavity, being joined to each other along a common edge extending longitudinally of said cavity to provide said cavity with a cross-sectional configuration of an quadrilateral parallelogram along a major lengthwise portion thereof.

18. The multipiece tooth assembly according to claim 14 wherein the axially aligned openings in said tooth define an axis which intersects opposed angled sides on the top and bottom surfaces of said cavity and extends at an angle generally normal to the angles sides of the cavity defined by said tooth.

19. The multipiece tooth assembly according to claim 18 wherein said axis defined by the axially aligned openings in said tooth extends at an angle of about 45° relative to a generally horizontal plane.

20. A digging tooth, comprising:

an elongated generally wedge shaped member having a ground penetrating edge extending generally transversely across a forward end thereof, said ground penetrating edge extending generally parallel to an edge of ground engaging equipment when said tooth is attached thereto, and with a rear end of said elongated member defining a blind cavity open to a rear end of said member, and wherein said blind cavity defines top and bottom surfaces converging toward each other and the forward end of said member, with each top and bottom surface of said blind cavity including two angled sides each extending at and acute angle ranging between about 40° and 65° relative to the ground penetrating edge, with each angled side of the top and bottom surfaces being disposed to opposite lateral sides of a longitudinal centerline of said member, and with the angled sides of said top surface of said cavity being joined to each other along a common edge. and wherein said tooth further defines a pair of axially aligned openings disposed along an axis extending at an acute angle ranging between about 40° and 55° relative to the ground penetrating edge, and with the axis defined by said openings intersecting with the longitudinal centerline of said member and is generally centered on opposite sides of said top and bottom surfaces of said cavity to facilitate access to retainer pin structure passing therethrough.

21. An excavating tooth, comprising:

an elongated generally wedge shaped member having a ground penetrating edge extending generally transversely across a forward end thereof, said ground penetrating edge extending generally parallel to an edge of ground engaging equipment when said tooth is attached thereto and with a rear end of said elongated member defining a blind cavity open to a rear end of said member, and wherein said blind cavity defines top and bottom surfaces converging toward each other and the forward end of said member with each top and bottom surface of said blind cavity including two angled sides each extending at and acute angle ranging between about 40° and about 65° relative to the ground penetrating edge, with each angled side of the bop and bottom surfaces being disposed to opposite lateral sides of a longitudinal centerline of said member, and wherein the angled sides of said bottom surface of said cavity are joined to each other along a common edge, and wherein said tooth further defines a pair of axially aligned openings disposed along an axis extending at and acute angle ranging between about 40° and about 55° relative to the ground penetrating edge, and with the axis defined by said openings intersecting the longitudinal centerline of said member and is generally centered on opposite sides of said top and bottom surfaces of said cavity to facilitate access to retainer pin structure passing therethrougl.

22. A digging tooth, comprising:

an elongated generally wedge shaped member having a ground penetrating edge extending generally transversely across a forward end thereof, said ground penetrating edge extending generally parallel to an edge of ground engaging equipment when said tooth is attached thereto, and with a rear end of said elongated member defining a blind cavity open to a rear end of said member, and wherein said blind cavity defines top and bottom surfaces converging toward each other and the forward end of said member such that said blind cavity has a reduction in cross-sectional area from a forward end to a rearward end thereof, with said top surface of said blind cavity including two downwardly angled sides disposed to opposite lateral sides of a longitudinal centerline of said member and with each extending at and acute angle ranging between about 40° and about 65° relative to the ground penetrating edge, with said bottom surface of said blind cavity including two upwardly angled sides disposed to opposite lateral sides of the longitudinal centerline of said member and with each extending at and acute angle ranging between about 40° and about 65° relative to the ground penetrating edge, and wherein at least one angled side of either the top or bottom surface of said cavity on said tooth further defines a throughbore extending along an axis passing through said longitudinal centerline of said elongated member at an angle ranging between about 40° and about 55° relative to the ground penetrating edge of said member.

23. A digging tooth comprising:

an elongated generally wedge shaped member having a ground penetrating edge extending generally transversely across a forward end thereof said ground penetrating edge extending generally parallel to an edge of ground engaging equipment when said tooth is attached thereto, and with a rear end of said elongated member defining a blind cavity open to a rear end of said member and wherein said blind cavity defines top and bottom surfaces converging toward each other and the forward end of said member such that said blind cavity has a reduction in cross-sectional area from a forward end to a rearward end thereof,with said top surface of said blind cavity including two downwardly angled sides disposed to opposite lateral sides of a longitudinal centerline of said member and with each extending at and acute angle ranging between about 40° and about 65° relative to the ground penetrating edge, and wherein the angled sides of said top surface of said cavity are joined to each other along a common edge, with said bottom surface of said blind cavity including two upwardly angled sides disposed to opposite lateral sides of the longitudinal centerline of said member and with each extending at and acute angle of about 40° and about 65° relative to the ground penetrating edge, and wherein said tooth further defines a pair of axially aligned openings extending along an axis passing through said longitudinal centerline of said elongated member and intersecting opposite sides on the top and bottom surfaces of the blind cavity to define a shortest distance across a cross-sectional area of said cavity of said elongated member.

24. A digging tooth comprising:

an elongated generally wedge shaped member having a ground penetrating edge extending generally transversely across a forward end thereof, said ground penetrating edge extending generally parallel to an edge of ground engaging equipment when said tooth is attached thereto, and with a rear end of said elongated member defining a blind cavity open to a rear end of said member, and wherein said blind cavity defines top and bottom surfaces converging toward each other and the forward end of said member such that said blind cavity has a reduction in cross-sectional area from a forward end to a rearward end thereof with said top surface of said blind cavity including two downwardly angled sides disposed to opposite lateral sides of a longitudinal centerline of said member and with each extending at and acute angle ranging between about 40° and about 65° relative to the ground penetrating edge, with said bottom surface of said blind cavity including two upwardly angled sides disposed to opposite lateral sides of the longitudinal centerline of said member and with each extending at and acute angle ranging between about 40° and about 65° relative to the ground penetrating edge, and wherein the angled sides of said bottom surface of said cavity are joined to each other along a common edge, and wherein said tooth further defines a pair of axially aligned openings extending along an axis passing through said longitudinal centerline of said elongated member and intersecting opposite sides on the top and bottom surfaces of the blind cavity to define a shortest distance across a cross-sectional area of said cavity of said elongated member.

25. A digging tooth comprising:

an elongated generally wedge shaped member having a ground penetrating edge extending generally transversely across a forward end thereof, said ground penetrating edge extending generally parallel to an edge of ground enoaging equipment when said tooth is attached thereto, and with a rear end of said elongated member defining a blind cavity open to a rear end of said member, and wherein said blind cavity defines top and bottom surfaces converging toward each other and the forward end of said member such that said blind cavity has a reduction in cross-sectional area from a forward end to a rearward end thereof, with said top surface of said blind cavity including two downwardly angled sides disposed to opposite lateral sides of a longitudinal centerline of said member and with each extending at and acute angle ranging between about 40° and about 65° relative to the ground penetrating edge, with said bottom surface of said blind cavity including two upwardly angled sides disposed to opposite lateral sides of the longitudinal centerline of said member and with each extending at and acute angle rangingbetween about 40° and about 65° relative to the ground penetrating edge and wherein all the angled sides of the blind cavity are joined to each other along common edges to provide said cavity with a cross-sectional configuration of a quadrilateral parallelogram along a major lengthwise portion thereof, and wherein said tooth further defines a pair of axially aligned openings extending along an axis passing through said longitudinal centerline of said elongated member and intersecting opposite sides on the top and bottom surfaces of the blind cavity to define a shortest distance across a cross-sectional area of said cavity of said elongated member.

26. A digging tooth, comprising:

a wedge shaped ground engaging member having a ground penetrating edge extending generally transversely across a forward end thereof, said ground penetrating edge extending generally parallel to an edge of ground engaging equipment when said tooth is attached thereto, and with a rear end of said member defining a blind cavity open to a rear end of said member, and wherein said blind cavity defines top and bottom surfaces converging toward each other and the forward end of said member such that said blind cavity has a reduction in cross-sectional area from a forward end to a rearward end thereof, with said top surface of said blind cavity including two downwardly angled sides disposed to opposite lateral sides of a longitudinal centerline of said member and with each extending at and acute angle ranging between about 40° and about 65° relative to the ground penetrating edge, with said bottom surface of said blind cavity including two upwardly angled sides disposed to opposite lateral sides of the longitudinal centerline of said member and with each extending at and acute angle relative to the ground penetrating edge, and wherein said member further defines a pair of axially aligned openings extending along an axis passing through said longitudinal centerline of said elongated member and at an angle of about 45° relative to the ground penetrating edge of said member.

27. The excavating tooth according to claim 26 wherein the angled sides of said top surface of said cavity are joined to each other along a common radiused edge.

28. The excavating tooth according to claim 26 wherein the angled sides of said bottom surface of said cavity are joined to each other along a common radiused edge.

29. The excavating tooth according to claim 26 wherein all the angled sides of the blind cavity are joined to each other along common edges to provide said cavity with a cross-sectional configuration of a quadrilateral parallelogram along a major lengthwise portion thereof.

30. A multipiece excavating tooth assembly, comprising:

an elongated generally wedge shaped tooth having a ground penetrating edge extending generally transversely across a forward end thereof, said ground penetrating edge extending generally parallel to an edge of ground engaging equipment when said tooth is attached thereto, and with a rear end of said tooth defining a blind cavity open to the rear end of said tooth, and wherein said blind cavity defines top and bottom surfaces converging toward each other and the forward end of said tooth such that said blind cavity has a reduction in cross-sectional area from the rear end to the forward end thereof, with said top surface of said blind cavity including two downwardly angled sides disposed to opposite lateral sides of a longitudinal centerline of said member and with each extending at and acute angle ranging between about 40° and 65° relative to the ground penetrating edge, with said bottom surface of said blind cavity including two upwardly angled sides disposed to opposite lateral sides of the longitudinal centerline of said tooth and with each extending at and acute angle relative to the ground penetrating edge, and wherein said tooth further defines a pair of axially aligned openings extending along an axis passing through said longitudinal centerline of said tooth and at an angle of about 45° relative to the ground penetrating edge of said tooth;

an adapter having a nose portion configured to fit endwise within said blind cavity defined by said tooth, said nose portion defining an open ended bore arranged in general fore-and-aft alignment with the openings defined by said tooth when said tooth and adapter are arranged in operable combination relative to each other, and wherein said adapter further includes a base portion for permitting said adapter to be connected to the edge of said ground engaging equipment; and retaining pin apparatus configured to pass endwise at least partially through said openings in said tooth and the bore in said adapter thereby attaching said tooth and said adapter in operable combination relative to each other.

31. An adapter for a multipiece excavating tooth assembly, comprising:

an elongated member having a base portion and an elongated nose portion axially arranged relative to each other along a longitudinal centerline of said member, said base portion being configured to permit attachment of said adapter to excavating equipment, and wherein said elongated nose portion terminates at a free forward end and has top and bottom angled surfaces disposed generally above and below the longitudinal centerline of said member, respectively, with the top surface of said nose portion having two downwardly disposed and angled sides arranged on opposite lateral sides of the longitudinal centerline of said member, and with the bottom surface of said nose portion having two upwardly disposed and angled sides arranged on opposed sides of the longitudinal centerline of said member, with each angled side of said bottom surface extending at an angle ranging between about 40° and about 650 relative to a generally horizontal plane, and with said nose portion further defining a recess disposed adjacent a rear end of the nose portion, said recess extending along an axis and opening to at least one angled side of said bottom surface of the nose portion of said member and wherein said recess is disposed along an axis passing through the longitudinal centerline of said elongated member and at an angle ranging between about 40° and about 55° relative to a generally horizontal plane.

32. The adapter accorditig to claim 31 wherein the angled sides of said top surface are joined to each other along a common edge.

33. The adapter according to claim 31 wherein the angled sides of said top surface are joined to each other along a radiused edge.

34. The adapter according to claim 31 wherein the recess deemed by said adapter comprises an elongated throughbore which opens at opposite ends thereof to opposed angled sides of said top and bottom surfaces.

35. A multipiece digging tooth assembly, comprising:

an adapter having a base portion and an elongated nose portion axially arranged relative to each other along a longitudinal centerline of said adapter, said base portion being configured to permit attachment of said adapter to excavating equipment, and wherein said elongated nose portion terminates at a free forward end and has top and bottom angled surfaces disposed generally above and below the longitudinal centerline of said member, respectively, with the top surface of said nose portion having two downwardly disposed and angled sides arranged on opposite lateral sides of the longitudinal centerline of said member, with each angled side of said top surface extending at an angle ranging between about 40° and about 65° relative to a generally horizontal plane, and with the bottom surface of said nose portion having two upwardly disposed and angled sides arranged on opposed sides of the longitudinal centerline of said member, and with said nose portion further defining a recess disposed adjacent a rear end of the nose portion, said recess extending along an axis and opening to at least one angled side of said bottom surface of the nose portion of said member and wherein said recess is disposed along an axis passing through the longitudinal centerline of said elongated member and extends at an angle ranging between about 40° and about 55° relative to a generally horizontal plane;

a digging tooth configured to fit along an about a lengthwise section of said nose portion of the adapter, with said tooth defining a throughbore which is in general registry with the recess in said adapter when said digging tooth and adapter are arranged in operable combination relative to each other; and a retaining apparatus configured to be at least partially seated in the recess of said adapter and at least partially extending through the throughbore in said tooth for releasably maintaining said adapter and tooth in operable combination relative to each other.

36. A multipiece excavating tooth assembly, comprising:

an elongated digging tooth having a ground penetrating end defined by an edge operably extending across a longitudinal axis of said tooth, and with a rear end of said tooth defining a blind cavity open to the rear end of said tooth, and wherein said blind cavity defines top and bottom surfaces converging toward each other and the forward end of said tooth such that said blind cavity has a reduction in cross-sectional area from the forward end to a rearward end thereof, with said top surface of said blind cavity including two downwardly angled sides disposed to opposite lateral sides of the longitudinal centerline of the tooth and with each side extending at an angle ranging between about 40° and about 65° relative to a generally horizontal plane, and wherein at least one angled side on the top surface of said cavity defines a throughbore extending along an axis passing through the longitudinal centerline of the tooth and disposed at an angle ranging between about 40° and about 55° relative to the generally horizontal plane;

an adapter having a base portion for permitting the multipiece tooth assembly to be operably connected to a ground engaging implement, said adapter further including a nose portion joined to said base portion and configured to fit endwise within and cooperate with the blind cavity in the tooth, said nose portion defining a recess toward a rear end thereof, with said recess and the throughbore opening in said tooth being arranged in general registry relative to each other when said tooth and adapter are arranged in operable combination relative to each other; and a retaining apparatus configured to be at least partially seated in the recess of said adapter and at least partially extending through the throughbore in said tooth for releasably maintaining said adapter and tooth in operable combination relative to each other.

* * * * *